US005798669A

United States Patent [19]

Klughart

[11] Patent Number: 5,798,669

[45] Date of Patent: Aug. 25, 1998

[54] TEMPERATURE COMPENSATED NANOPOWER VOLTAGE/CURRENT REFERENCE

[75] Inventor: Kevin Mark Klughart, Addison, Tex.

[73] Assignee: Dallas Semiconductor Corp., Dallas, Tex.

[21] Appl. No.: 678,339

[22] Filed: Jul. 11, 1996

[51] Int. Cl.[6] ..... G05F 1/10

[52] U.S. Cl. ..... 327/539; 327/543; 323/313; 323/315

[58] Field of Search ..... 327/530, 538, 327/539, 541, 543; 323/312, 313, 315

[56] References Cited

U.S. PATENT DOCUMENTS 5,512,816 4/1996 Lambert ..... 323/315
5,594,382 1/1997 Kato et al. ..... 327/539

OTHER PUBLICATIONS

Eric A. Vittoz et al., *A Low-Voltage CMOS Bandgap Reference*, IEEE Journal of Solid-State Circuits, vol. SC-14, No. 3, Jun. 1979 pp. 573-577.

Willy M. Sansen et al., *A CMOS Temperature-Compensated Current Reference*, IEEE Journal of Solid-State Circuits, vol. 23, No. 3, Jun. 1988, pp. 821-824.

Eric Vittoz et al., *CMOS Analog Integrated Circuits Based on Weak Inversion Operation*, IEEE Journal of Solid State Circuits, vol. SC-12, No. 3, Jun. 1977, pp. 224-231.

C. Toumazou et al., *Analogue IC Design: The Current-Mode Approach*, Analog Interface Circuits for VLSI, pp. 480-489.

*Primary Examiner*—Timothy P. Callahan
*Assistant Examiner*—Jung Ho Kim
*Attorney, Agent, or Firm*—Jenkens & Gilchrist

[57] ABSTRACT

An integrated voltage/current reference having substantially reduced temperature and voltage coefficient with simultaneous nanowatt power consumption includes a nanopower voltage/current reference topology having a substantial temperature coefficient and minimal voltage coefficient and augmented with a floating voltage proportional to absolute temperature (PTAT) within a feedback loop to compensate for differentials in β exponential temperature dependencies of N-Channel and P-Channel MOS devices used within commonly available semiconductor processes. The resulting reference supplies both voltage as well as current references which have greatly reduced temperature coefficients. In addition, the resulting circuit topology generates a voltage reference which has a parabolic temperature coefficient similar to that produced by a conventional bandgap reference. The turnover temperature, or point of zero temperature coefficient, with this new circuit topology can be made to coincide with the turnover temperature of the crystal resonator used within conventional watch crystal oscillator circuits, making this new topology preferable over existing voltage/current reference circuit topologies.

7 Claims, 15 Drawing Sheets

TEMPERATURE COMPENSATED NANOPOWER VOLTAGE/CURRENT REFERENCE

A portion of the disclosure of this patent document contains material which is subject to copyright protection. The copyright owner has no objection to the facsimile reproduction by any one of the patent disclosure, as it appears in the United States Patent and Trademark office patent files or records, but otherwise reserves all copyright rights whatsoever.

FIELD OF THE INVENTION

This invention relates to low power voltage and current references, and more particularly, to an integrated voltage/current reference having substantially reduced temperature and voltage coefficient with nanowatt power consumption.

BACKGROUND OF THE INVENTION

CMOS voltage and current references have been discussed in the literature extensively since Eric Vittoz and Jean Fellrath first described a simple CMOS current reference operating in weak inversion in 1977.[1] It is in recent years that the temperature characteristics of such low power reference circuits have come under scrutiny in an attempt to make the reference voltages/currents stable under a variety of operating temperatures.

[1] Eric Vottoz and Jean Fellrath, "CMOS Analog Integrated Circuits Based On Weak Inversion Operation," *IEEE Journal of Solid-State Circuits*, June, 1977, pp. 224–231.

The applicable prior technology can be described substantially in terms of the baseline voltage/current reference illustrated in FIG. 1. This drawing is a baseline implementation of the reference described by Evert Seevinck and published in 1990.[2] Major ideas regarding the concept of a reduced voltage generator used to lower active power levels present in the Seevinck publication were also described in a paper by Vincent Von Kaenel, Peter Macken, and Marc G. R. DeGrauwe in 1990.[3] Note that MOS devices in FIG. 1 are sized for a 0.8 μm layout shrunk by a multiplication factor of 0.8 to target a 0.6 μm process. PWELLs are tied to VSS (GROUND) and NWELLs to VDD (POWER) if not otherwise indicated.

[2] Evert Seevinck, "Nanopower CMOS Voltage and Current Reference," Analogue IC Design: *The Current Mode Approach*, edited by C. Toumazou, F. J. Lidgey, and D. G. Haigh. Exeter, United Kingdom: Peter Peregrinus Ltd., 1993, pp. 481–489.

[3] Vincent Von Kaenel, Peter Macken, and Marc G. R. DeGrauwe, "A Voltage Reduction Technique for Battery-Operated Systems," *IEEE Journal of Solid-State Circuits*, October, 1990, pp. 1136–1140.

Referring now to FIG. 1, it can be seen that the feedback loop comprising N-Channel MOSFET 103, N-Channel MOSFET 102, P-Channel MOSFET 203, and P-Channel MOSFET 202 is designed to provide a loop gain greater than unity. N-Channel MOSFET 101 takes the place of the conventional resistor used in bandgap circuits of similar topology. The current through N-Channel MOSFET 101 increases until the current gain of N-Channel MOSFET 102 is reduced due to lowered gate-source voltage at node VGS 301. Assuming P-Channel MOSFET 202, P-Channel MOSFET 203, N-Channel MOSFET 102, and N-Channel MOSFET 103 are in weak inversion, their drain currents will be given by the following expressions:

$$I_D = SI_{DO}\exp\left(\frac{V_g}{nU_T}\right)\left[\exp\left(-\frac{V_s}{U_T}\right)-\exp\left(-\frac{V_D}{U_T}\right)\right] \quad (1)$$

$U_T$=(kT)/q thermal voltage

S=strength factor W/L $V_G$=gate voltage $V_S$=source voltage $V_D$=drain voltage n=slope factor (1.557 for NCH, 1.853 for PCH)

$I_{DO}$=threshold scaling (215*a* for NCH, 562*a* for PCH)

Note that N-Channel MOSFET 101 is weakly sized and that its gate voltage is fixed at $V_{REF}$. Since N-Channel MOSFET 102 is in weak inversion, this means that N-Channel MOSFET 101 is operating in its linear region ($V_{GN1}<V_{TN1}$ and $V_{DSN1}<V_{GN1}$), making its current and resistance equations easily deduced from the following calculations (note: N1 corresponds to N-Channel MOSFET 101):

$$\begin{aligned} I_{DN1} &= \frac{\mu_n\epsilon}{t_{ox}}\frac{W_{N1}}{L_{N1}}\left[(V_{GSN1}-V_{TN})V_{DSN1}-\frac{(V_{DSN1})^2}{2}\right] \\ &= \beta_{N1}\left[(V_{REF}-V_{TN})V_{GS}-\frac{(V_{GS})^2}{2}\right] \end{aligned} \quad (2)$$

$$\begin{aligned} g_{DSN1} &= \frac{\partial}{\partial V_{DSN1}} I_{DSN1} \\ &\approx \beta_{N1}[V_{REF}-V_{TN}-V_{GS}] \\ R_{DSN1} &\approx \frac{1}{\beta_{N1}[V_{REF}-V_{TN}-V_{GS}]} \end{aligned} \quad (3)$$

The equivalent N-Channel MOSFET 101 drain resistance is temperature dependent based on two factors, the mobility μ in the $\beta_{N1}$ expression and the threshold voltage $V_{TN}$. The dependence of β on temperature is given by the following expression:

$$\begin{aligned} \beta_n &= \frac{\mu_n\epsilon}{t_{ox}}\frac{W}{L} \\ &= \beta_{NOM}\left(\frac{T}{T_{NOM}}\right)^{B_{EX}} \end{aligned}$$

$B_{EX}$=β temperature degradation factor: −1.70 for NCH, −1.25 for PCH (4)

T=device temperature (K)

$T_{NOM}$=nominal temperature (300K)

Note from these expressions the traditional reduction in effective β due to increases in temperature. This contrasts directly with the increase in delta $V_{GS}$ due to increases in the thermal voltage term in equation (2). The threshold voltage $V_{TN}$ is a complex function of temperature. The following series of expressions is a rough attempt to express the threshold voltage in terms of a function of temperature and other well-defined physical quantities. From this it is possible to deduce that the threshold voltage to first order is proportional to absolute temperature (PTAT):

$$
\begin{aligned}
V_{TN} &= V_{TO} + V_{FB} \\
&= 2\phi_b + \frac{Q_b}{C_{ox}} + V_{FB} \\
&= 2\frac{kT}{q}\ln\left(\frac{N_c}{N_i}\right) + \frac{Q_b}{C_{ox}} + V_{FB} \\
&= 2\frac{kT}{q}\ln\left(\frac{N_A}{N_i}\right) + \frac{\sqrt{2\epsilon q N_A 2\phi_b}}{C_{ox}} + V_{FB} \\
&= 2\frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} + V_{FB} \\
&= 2\frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} + \phi_{ms} - \frac{Q_{fc}}{C_{ox}} \\
&= 2\frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} - \left(\frac{E_g}{2} + \phi_b\right) - \frac{Q_{fc}}{C_{ox}} \\
&= 2\frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} - \frac{E_g}{2} - \frac{kT}{q}\ln\left(\frac{N_A}{N_i}\right) - \frac{Q_{fc}}{C_{ox}} \\
&= \frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} - \frac{E_g}{2} - \frac{Q_{fc}}{C_{ox}} \\
&= \frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} - \frac{1.16 - 0.000704\left(\frac{T^2}{T+1108}\right)}{2} - \frac{Q_{fc}}{C_{ox}} \\
&= \frac{kT}{q}\ln\left(\frac{N_A}{N_i}\right) + \frac{1}{C_{ox}}\sqrt{4\epsilon q N_A \frac{kT}{q}\ln\left(\frac{N_A}{N_i}\right)} - 0.580 + 0.000352\left(\frac{T^2}{T+1108}\right) - \frac{Q_{fc}}{C_{ox}}
\end{aligned}
\tag{5}
$$

A reasonable approximation to the temperature coefficient of the threshold voltage using the above formula is −1.408 mV/°C. for NCH devices and −1.476 mV/°C. for PCH devices. Typical threshold performance characteristics over temperature for N-Channel and P-Channel devices are illustrated in FIG. 13.

The potential difference in the gate-source voltages of N-Channel MOSFET 102/N-Channel MOSFET 103 will be equivalent to the node voltage VGS 301. This can be calculated by computing the drain currents of N-Channel MOSFET 102/N-Channel MOSFET 103 in terms of currents $I_L$ and $I_R$ as follows (note: N2, N3, P2, P3, P4, and P5 correspond to N-Channel MOSFETs 102 and 103, and P-Channel MOSFETs 202, 203, 204 and 205, respectively):

$$
\begin{aligned}
&U_T \equiv \frac{kT}{q} \\
&S_x \equiv \frac{W_x}{L_x} \\
&I_L = S_{N2} I_{D0} \exp\left(\frac{V_R - V_{GS}}{nU_T}\right)\left[\exp\left(-\frac{0}{U_T}\right) - \exp\left(-\frac{V_L}{U_T}\right)\right] \\
&I_R = S_{N3} I_{D0} \exp\left(\frac{V_R}{nU_T}\right)\left[\exp\left(-\frac{0}{U_T}\right) - \exp\left(-\frac{V_R}{U_T}\right)\right] = \frac{S_{P2}}{S_{P3}} I_L \frac{S_{P4}}{S_{P4} + S_{P5}} \\
&\qquad\qquad \Downarrow \\
&\left[1 - \exp\left(-\frac{V_R}{U_T}\right)\right] = \frac{S_{P2}}{S_{P3}} \frac{S_{N2}}{S_{N3}} \frac{S_{P4}}{S_{P4} + S_{P5}} \exp\left(-\frac{V_{GS}}{nU_T}\right)\left[1 - \exp\left(-\frac{V_L}{U_T}\right)\right] \\
&\exp\left(-\frac{V_{GS}}{nU_T}\right) = \frac{S_{P3}}{S_{P2}} \frac{S_{N3}}{S_{N2}} \frac{S_{P4} + S_{P5}}{S_{P4}} \left[1 - \exp\left(-\frac{V_R}{U_T}\right)\right]\left[1 - \exp\left(-\frac{V_L}{U_T}\right)\right]^{-1} \\
&V_{GS} = -nU_T \ln\left\{\frac{S_{P3}}{S_{P2}} \frac{S_{N3}}{S_{N2}} \frac{S_{P4} + S_{P5}}{S_{P4}} \left[1 - \exp\left(-\frac{V_R}{U_T}\right)\right]\left[1 - \exp\left(-\frac{V_L}{U_T}\right)\right]^{-1}\right\} = nU_T \ln\left(\frac{S_{P2}}{S_{P3}} \frac{S_{N2}}{S_{N3}} \frac{S_{P4}}{S_{P4} + S_{P5}}\right)
\end{aligned}
\tag{6}
$$

The current through N-Channel MOSFET 101 is given by the ratio of $V_{GS}/R_{DSN1}$:

$$I_{DSN1} = \frac{V_{GS}}{R_{DSN1}} = \frac{\frac{kT}{q}\ln\left(\frac{S_{N2}}{S_{N3}}\frac{S_{P2}}{S_{P3}}\frac{S_{P4}}{S_{P4}+S_{P5}}\right)}{\beta_{NOM}\left(\frac{T}{T_{NOM}}\right)^{-1.7}|V_{REF}-V_{TN}-V_{GS}|} = \frac{\frac{kT(300K)}{q}\ln\left(\frac{S_{N2}}{S_{N3}}\frac{S_{P2}}{S_{P3}}\right)}{\beta_{N1NOM}T^{1.7}|V_{REF}-V_{TN}-V_{GS}|} = \frac{\frac{k(300K)}{q}\ln\left(\frac{S_{N2}}{S_{N3}}\frac{S_{P2}}{S_{P3}}\frac{S_{P4}}{S_{P4}+S_{P5}}\right)}{\beta_{N1NOM}T^{0.7}|V_{REF}-V_{TN}-V_{GS}|} \quad (7)$$

It is clear that this term is somewhat dependent on temperature, although not as much as would be expected in a design using a simple integrated resistor as a replacement for N-Channel MOSFET 101. As is known by those skilled in the art, in a conventional design using a resistor as a replacement for N-Channel MOSFET 101, the reference current would be directly proportional to absolute temperature.

Reference Voltage Calculation $V_{REF}$ can be calculated explicitly by observing that P-Channel MOSFET 205 and P-Channel MOSFET 206 operate in saturation (strong inversion) and as such their operation can be described in terms of their gate-source voltages and drain current (note: P6 corresponds to P-Channel MOSFET 206):

$$I_{DSP5} = \frac{\beta_{P5}}{2}[(V_{REF}-V_F)-V_{TP}]^2$$

$$I_{DSP6} = \frac{\beta_{P6}}{2}[V_F-V_{TP}]^2 \quad (8)$$

$$\Downarrow$$

$$V_{REF}-V_F = \sqrt{\frac{2I_{DSP5}}{\beta_{P5}}} + V_{TP}$$

$$V_F = \sqrt{\frac{2I_{DSP6}}{\beta_{P6}}} + V_{TP}$$

From this we can explicitly solve for the reference voltage $V_{REF}$ by noting that $I_{DSP5}=I_{DSP6}=I_F$, the feedback current:

$$V_{REF} = 2V_{TP}+\sqrt{\frac{2I_F}{\beta_{P5}}}+\sqrt{\frac{2I_F}{\beta_{P6}}} = 2V_{TP}+\sqrt{2I_F}\left(\sqrt{\frac{1}{\beta_{P5}}}+\sqrt{\frac{1}{\beta_{P6}}}\right) \quad (9)$$

If P-Channel MOSFET 205 and P-Channel MOSFET 206 are sized identically, this reduces to $$V_{REF} = m\left(V_{TP}+\sqrt{\frac{2I_F}{\beta_{P5,P6}}}\right) \quad (10)$$

With m the integer number of diode-connected PCH MOS devices comprising the feedback loop P-Channel MOSFET 205, P-Channel MOSFET 206=2 in this implementation). We now need an expression for $I_F$ in terms of $V_{REF}$. To obtain this we relate the drain current of N-Channel MOSFET 101 to the expressions for $V_{GS}$ and $R_{DSN1}$ and solve for $I_F$:

$$I_{DSN1} = \frac{V_{GS}}{R_{DSN1}} = I_L + I_F = \frac{S_{P3}}{S_{P2}}I_R + I_F = \frac{S_{P3}}{S_{P2}}\frac{S_{P4}+S_{P5}}{S_{P4}}I_F + I_F = I_F\left[1+\frac{S_{P3}}{S_{P2}}\frac{S_{P4}+S_{P5}}{S_{P4}}\right] \quad (11)$$

$$\Downarrow$$

$$I_F = \frac{V_{GS}}{R_{DSN1}}\left[1+\frac{S_{P3}}{S_{P2}}\frac{S_{P4}+S_{P5}}{S_{P4}}\right]^{-1}$$

We now substitute this expression into our previous expression for $V_{REF}$:

$$V_{REF} = m\left(V_{TP}+\sqrt{\frac{2I_F}{\beta_{P5,P6}}}\right) = m\left(V_{TP}+\sqrt{\frac{\frac{(2)(V_{GS})}{R_{DSN1}}\left[1+\frac{S_{P3}}{S_{P2}}\frac{S_{P4}+S_{P5}}{S_{P4}}\right]^{-1}}{\beta_{P5,P6}}}\right) = m\left(V_{TP}+\sqrt{\frac{\frac{2V_{GS}}{\frac{1}{\beta_{N1}[V_{REF}-V_{TN}-V_{GS}]}}\left[1+\frac{S_{P3}}{S_{P2}}\frac{S_{P4}+S_{P5}}{S_{P4}}\right]^{-1}}{\beta_{P5,P6}}}\right)$$

-continued $$= m\left(V_{TP} + \sqrt{\frac{2\beta_{N1}V_{GS}|V_{REF} - V_{TN} - V_{GS}|}{\beta_{P5,P6}\left[1 + \frac{S_{p3}}{S_{P2}}\frac{S_{P4}+S_{P5}}{S_{P4}}\right]}}\right)$$

This expression can be solved explicitly for $V_{REF}$ to obtain the following expressions:

$$V_{REF} = m\sqrt{S_{REF}V_{GS}\left(mV_{TP} - V_{TN} + \left(\frac{1}{4}S_{REF}m^2 - 1\right)V_{GS}\right)} + mV_{TP} + \frac{1}{2}S_{REF}m^2V_{GS} \quad (13)$$

$$V_{GS} \equiv n_{mch}U_T\ln\left(\frac{S_{P2}}{S_{P3}}\frac{S_{N2}}{S_{N3}}\frac{S_{P4}}{S_{P4}+S_{P5}}\right)$$

$$S_{REF} \equiv \frac{2\beta_{N1}}{\beta_{P5,P6}\left[1 + \frac{S_{P3}}{S_{P2}}\frac{S_{P4}+S_{P5}}{S_{P4}}\right]}$$

Ideal β Temperature Dependence

It is possible to use the above defined expression for the reference voltage $V_{REF}$ to calculate the reference temperature dependence in cases of ideal β temperature dependence (BEX=−1.5) as assumed by Seevinck. We start by noting the temperature dependence of the $V_{GS}$ and $S_{REF}$ size/shape terms and then substitute known process values into our expression for $V_{REF}$:

$$V_{GS} \propto V_{GST} \times T$$

$$S_{REF} \propto S_{REFT} \times \frac{T^{-1.5}}{T^{-1.5}} \approx S_{REFT} \times 1$$

$$V_{TN} \propto V_{TNT} \times T$$
$$V_{TP} \propto V_{TPT} \times T$$

$$\frac{\partial V_{REF}}{\partial T} = 0 \text{ for zero temperature coefficient}$$

$$= \frac{\left(\begin{array}{c}(2mV_{TPT} + m^2S_{REFT}V_{GST})\sqrt{S_{REFT}V_{GST}(4mV_{TPT} - 4V_{TNT} + (m^2S_{REFT} - 4)V_{GST})} + \\ mS_{REFT}V_{GST}(4mV_{TPT} - 4V_{TNT} + (m^2S_{REFT} - 4)V_{GST})\end{array}\right)}{2\sqrt{S_{REFT}V_{GST}(4mV_{TPT} - 4V_{TNT} + (m^2S_{REFT} - 4)V_{GST})}}$$

$$\Downarrow$$

$$0 = \left(\begin{array}{c}(2mV_{TPT} + m^2S_{REFT}V_{GST})\sqrt{S_{REFT}V_{GST}(4mV_{TPT} - 4V_{TNT} + (m^2S_{REFT} - 4)V_{GST})} + \\ mS_{REFT}V_{GST}(4mV_{TPT} - 4V_{TNT} + (m^2S_{REFT} - 4)V_{GST})\end{array}\right)$$

Where variable names subscripted with a terminal "T" indicate the non-temperature dependent size/shape coefficient of the appropriate circuit variable. As seen from the partial derivative, the temperature coefficient is determined solely by the shape parameters of the circuit and not by the absolute temperature T, as the temperature variable is eliminated from the partial derivative. Thus, it is in theory possible to select shape parameters to solve the above equation and obtain a zero temperature coefficient over a broad range of temperature values using this baseline Seevinck circuit topology.

The Vittoz PTAT Voltage Reference

The following discussion directly references FIG. 5. In 1979 Eric Vittoz described a CMOS voltage reference which operated in the subthreshold region of MOS operation and which consumed very little power.[4] This reference generator produces a voltage which is proportional to absolute temperature (PTAT) over a wide range of operating temperatures. According to Vittoz, the PTAT voltage $V_{PTAT}$ 505 is determined primarily by the size and shape factors of the MOS devices used in constructing the circuit. The PTAT voltage according to Vittoz, assuming common well biasing for N-Channel MOSFET 501 and N-Channel MOSFET 502, is given by the following expression (note: M1 and M2 correspond to N-Channel MOSFETs 501 and 502):

$$V_{PTAT} = U_T\ln\left(1 + \frac{S_{M2}}{S_{M1}}\right) + \Delta V_0 \quad (15)$$

$$U_T \equiv \frac{kT}{q} \quad \text{thermal voltage}$$

$$S_{M1} \equiv \left(\frac{W_{M1}}{L_{M1}}\right) \quad \text{shape factor for } M1$$

$$S_{M2} \equiv \left(\frac{W_{M2}}{L_{M2}}\right) \quad \text{shape factor for } M2$$

$$\Delta V_0 \equiv \text{transistor mismatch offset voltage}$$

[4] Eric Vottoz and Olivier Neyroud, "A Low-Voltage CMOS Bandgap Reference," *IEEE Journal of Solid-State Circuits*, June, 1979, pp. 573–577.

However, a more accurate relationship between the PTAT voltage and the operating point of the transistors is given by the following formula:

$$V_{REF} = U_T\ln\left\{\frac{S_{M1} + S_{M2}}{S_{M1}\exp\left(-\frac{V_S}{U_T}\right) + S_{M2}\exp\left(-\frac{V_G}{U_T}\right)}\right\} \quad (16)$$

$$= U_T\ln\left\{1 + \frac{S_{M2}}{S_{M1}}\right\} \quad V_S = 0$$

Note that the PTAT voltage is a weak function of the gate-bulk bias point VG 504 as well as the source-bulk voltage VS 506. This effect can clearly be seen in FIG. 6 which illustrates that the slope and intercept of this PTAT reference changes based on the applied reference current. Note that in all cases the PTAT voltage has a positive temperature coefficient. There are a limited number of devices available in integrated form which have this characteristic.

The Sansen Current Reference

In 1988 Willy M. Sansen, Frank Op't Eynde, and Michiel Steyaert proposed using this PTAT voltage reference to temperature stabilize a current reference.[5] The temperature characteristic generated by their proposed implementation indicated a variation of approximately 25 nA over 75° C. for a current reference with a nominal value of approximately 750 nA. This corresponds to an average variation of 3%. A qualitative aspect of this current characteristic is that it is semi-linear and not parabolic as would be expected of a traditional bandgap reference. There are no nodes present in this current reference which can be used as a practical voltage reference over the range of circuit operating temperatures. Note also that the operating current of this circuit is approximately an order of magnitude greater than desirable in a nanopower class reference generator.

[5] Willy M. Sansen, Frank Op't Eynde, and Michiel Steyaert, "A CMOS Temperature-Compensated Current Reference," *IEEE Journal of Solid-State Circuits*, June, 1988, pp. 821–824.

Within the context of low power battery powered circuitry, it is often necessary to generate reference voltages and currents that are stable over ranges of battery supply voltage and operating temperature. One specific application that has stringent requirements on both power consumption and voltage/current reference stability over temperature is that of crystal controlled watch oscillators, which typically operate at 32768 Hz. These circuits typically utilize a 3V lithium battery as the primary source of power and have restrictions of less than 400 nA of operating current at room temperature to guarantee a 10 year battery lifespan. To achieve these ultra low power levels typically requires the use of a voltage or current reference to limit the operating current of the major power consumer in the circuit, the crystal oscillator amplifier and first three stages of digital binary frequency division (countdown chain).

Since the power consumed by the oscillator and countdown chain is proportional to the product of the switched load capacitance, the operating frequency, and the supply voltage squared, it is highly desirable to limit the operating voltage of the oscillator circuitry. This can be achieved by limiting the current to the oscillator using a current reference, or by generating a voltage reference and using this to power the circuit.

The use of a current reference is the predominant method of implementation used within the industry to date. The advantage of this implementation scheme is that it can easily be performed via the use of an integrated well resistor or a very weak MOS device operating in its linear (resistive) region of operation.

The drawback to this approach is threefold. First, due to processing variations both the well resistor and MOS device will produce currents which vary widely with each wafer lot. Second, both implementations have a significant temperature coefficient, making the operating current highly dependent on the ambient circuit temperature. Third, the use of a current reference means that the bias voltage applied to the oscillator amplifier drifts with temperature and other operating circuit parameters. Since the trim capacitors used to trim the crystal oscillator typically have a significant voltage coefficient (approximately 10000–40000 PPM/V), drifts in the bias point of the oscillator amplifier power supply will cause undesirable frequency shifts in the oscillation frequency.

The disadvantages present in the conventional current source approach to limiting the power within the oscillator amplifier are substantially overcome by using a voltage reference to source the crystal oscillator circuitry. By maintaining a stable supply voltage to the oscillator trim capacitors over temperature, the frequency stability of the overall system is improved substantially.

A major reason that this approach has not been attempted in the past is twofold. First, conventional approaches to solving this problem would use the battery as a reference and a resistive divider chain to generate a voltage on the order of 1.5 volts to power the crystal oscillator. Unfortunately, lithium batteries in general make very poor voltage references, as their output voltage has a temperature coefficient of as much as 4 mV/°C. with a nominal voltage of 2.8 volts at 0° C. Second, all conventional voltage references which have low temperature coefficients consume several microamps of current; far too much to be considered for this application.

An additional target application of the invention is that of generating a voltage/current reference for power fail/good/reset processing in systems which are parasite powered or which are powered by batteries and switch to power from conventional power sources when said sources are considered "good" or above a predetermined voltage threshold. For example, a circuit may have logic elements which are battery backed in the absence of external VDD power, but when external VDD power is above 1.5 volts, the circuit switches to using external VDD power.

In the past, the external VDD supplies were typically 5 volts. In this case the lithium battery in some cases could be used as a crude reference to determine when the external supply was valid, in that any external voltage greater than the battery voltage could be considered "good" for purposes of the battery switching logic. As external VDD power supplies have migrated from 5 volts to 3 volts, this approach to battery switching can no longer be used, because the external VDD supply and the lithium battery voltage have comparable voltage magnitudes. In fact, in many circumstances the battery voltage may be higher than the external VDD power supply voltage, making determination of a valid "good" external VDD supply voltage difficult over a wide range of operating temperatures. A suitable approach using one disclosed embodiment is to use the battery to generate a suitable voltage reference less than the battery (e.g., 1.5V) and then compare this value to the external VDD supply to determine if the external supply is "good" and as such can be considered valid for purposes of switching to external VDD power instead of relying on internal lithium battery power.

Similar methods may be used to generate power-on-reset pulses by comparing the external VDD supply voltage to the internally generated reference voltage. In both these cases many of the "chicken-and-egg" power sequencing problems that are encountered when attempting to design a circuit that generates its reference from the VDD supply to which it is making a comparison are eliminated or greatly reduced in complexity.

OBJECT OF THE INVENTION

Accordingly, it is an object of the present invention to provide an apparatus for generating reference voltages and currents which are substantially immune to changes in temperature and operating supply voltage while at the same time operating at power levels on the order of several hundred nanowatts or less.

It is a further object of the present invention to provide an apparatus for generating a reference voltage which is substantially temperature insensitive and capable of being operated by a standard lithium battery of approximately 3 volts.

It is yet another object of the present invention to provide a tunable circuit for providing a semi-parabolic temperature coefficient of voltage such that the turnover temperature is approximately room temperature (approximately 23° C.) thereby taking advantage of the parabolic nature of the voltage coefficient such that it can be used to advantage in temperature compensating crystal oscillators which in many cases also have a turnover temperature of approximately 23° C.

BRIEF DESCRIPTION OF THE DRAWINGS

A more complete understanding of the present invention may be had by reference to the following Detailed Description when taken in conjunction with the accompanying Drawings wherein.

DETAILED DESCRIPTION

Figure 1:
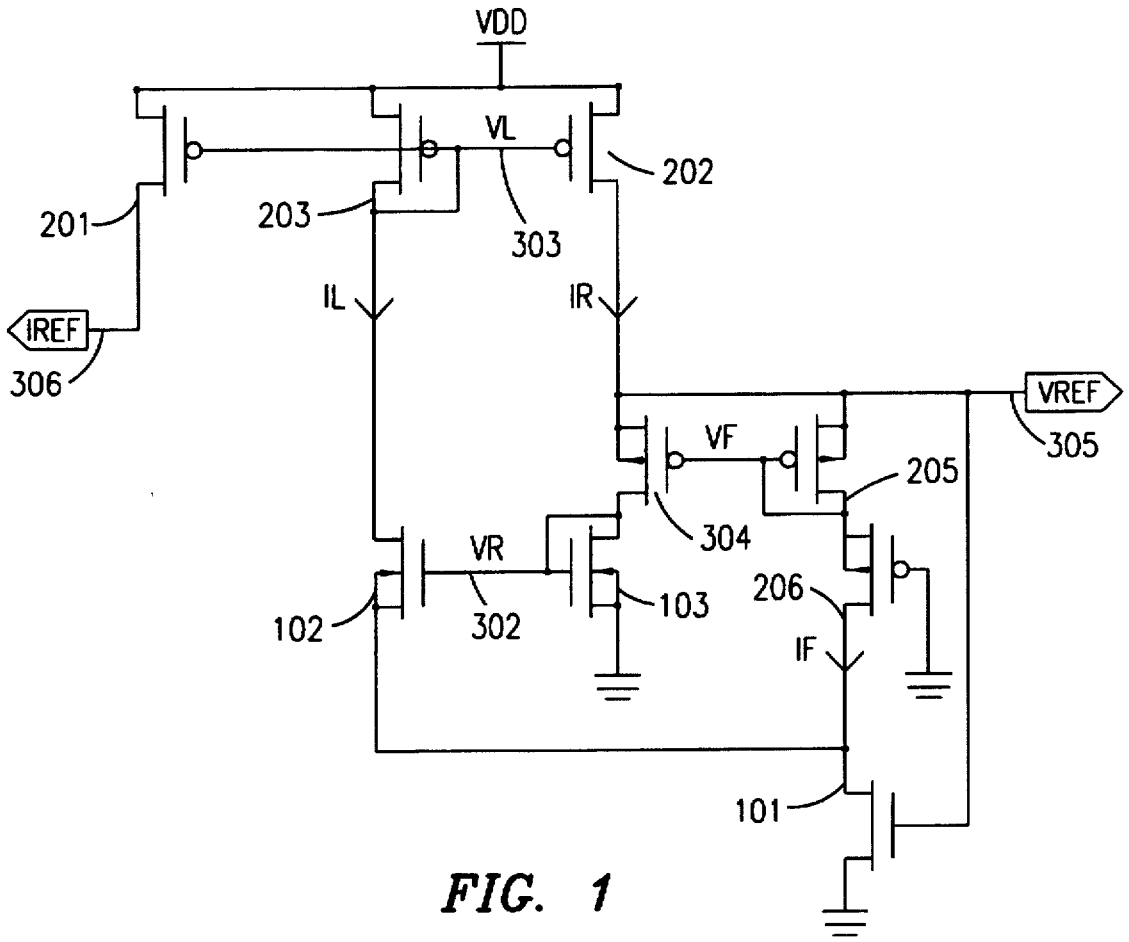
FIG. 1 is a schematic diagram illustrating a nanopower voltage/current reference using only MOS transistors.

Referring now to FIG. 1, which was described in detail above, there is illustrated a schematic depicting an implementation of a nanopower voltage/current reference using MOS transistors only. It is noted that the NWELLS are tied to VDD except as indicated in P-channel devices 204, 205 and 206. The devices sizes of each of the MOSFETs indicated in this drawing are approximate and highly process dependent. They are presented only as a guide to understanding the operating mode of each transistor in the circuit.

The circuit of FIG. 1 as requires near-ideal β exponential temperature coefficients of −1.5 to operate as described with minimal temperature coefficient. Many semiconductor fab process routinely have β values which are significantly divergent from this ideal value.

Figure 2:
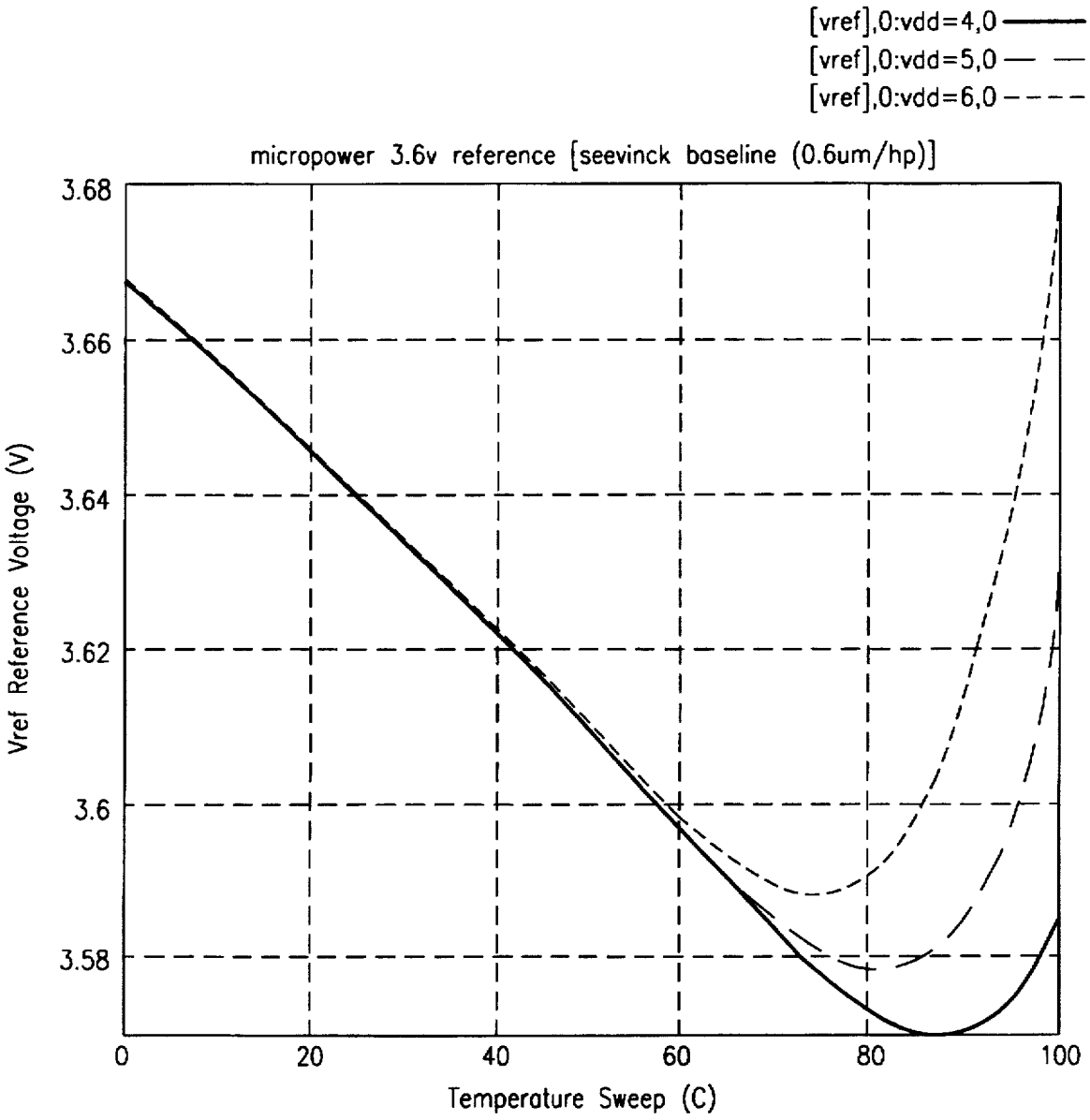
FIG. 2 is a graph illustrating a typical best case voltage regulation performance of the circuit shown in FIG. 1.

Referring now to FIG. 2, there is illustrated an graph depicting the typical best case voltage regulation performance of the circuit of FIG. 1 given a semiconductor fab process with NCH/PCH β exponential temperature coefficient values of −1.7 and −1.25, respectively. Note that there exists a significant temperature coefficient on the order of −1.25 mV/°C.

Modification of the MOS device sizes used in the circuit shown in FIG. 1 can not substantially reduce this temperature coefficient as can be shown via rigorous calculations. Note that the temperature coefficient of the circuit of FIG. 1 is negative. This is always the case given the non-ideal β process parameters given in the description of FIG. 1.

Figure 3:
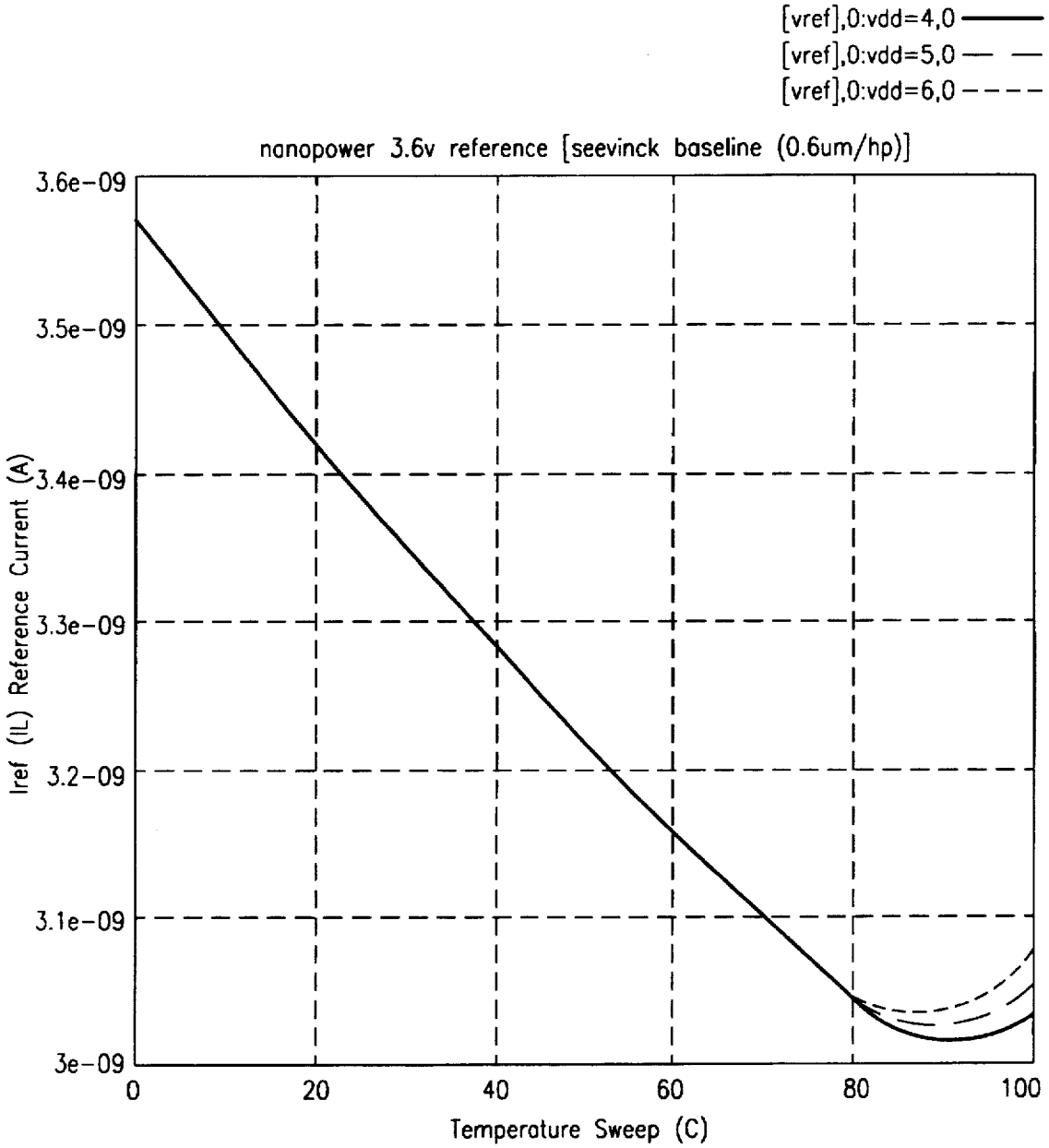
FIG. 3 is a graph illustrating a typical best case current regulation performance of the circuit shown in FIG. 1.

Referring now to FIG. 3, there is illustrated a graph depicting the typical best case current regulation performance of the circuit of FIG. 1 given a semiconductor fab process with NCH/PCH β exponential temperature coefficient values of −1.7 and −1.25 respectively. Note that there exists a significant negative temperature coefficient on the order of −6.8 nA/°C. to the reference current.

Figure 4:
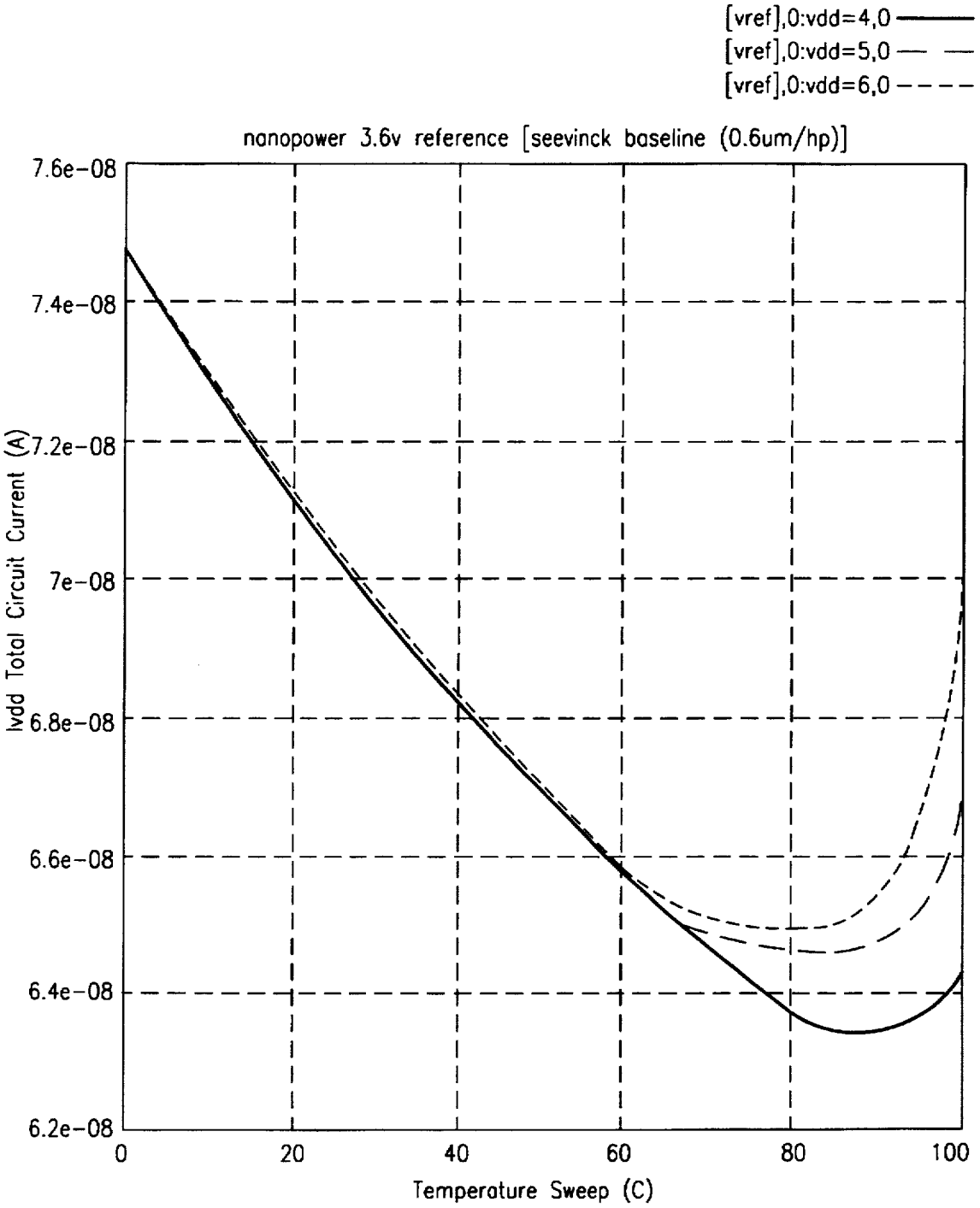
FIG. 4 is a graph illustrating a typical current consumption of a circuit as similarly shown in FIG. 1.

Referring now to FIG. 4, there is illustrated a graph depicting the typical current consumption of the circuit shown in FIG. 1 given a semiconductor fab process with NCH/PCH β exponential temperature coefficient values of −1.7 and −1.25 respectively. Note that the overall current consumption is very low, making this topology suitable for use with battery powered circuitry.

Figure 5:
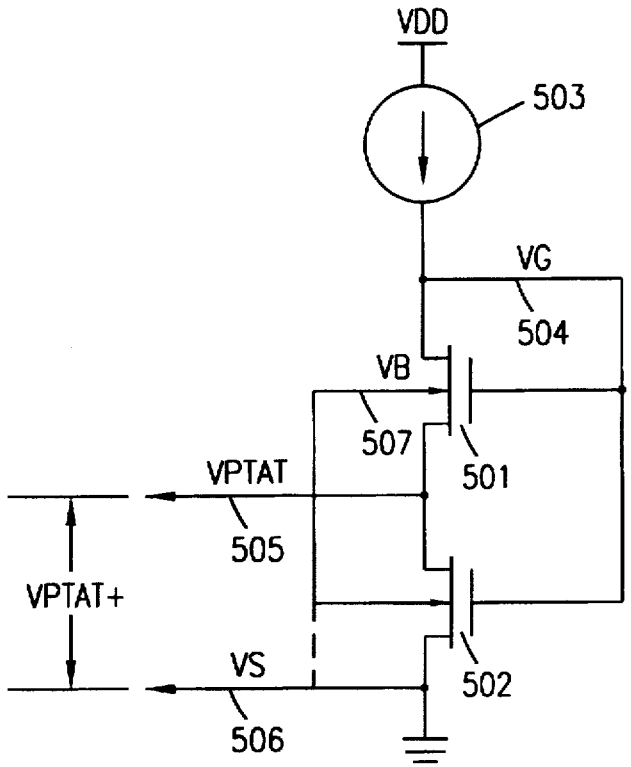
FIG. 5 is a schematic diagram illustrating a MOS voltage reference.

Referring now to FIG. 5, there is illustrated a MOS voltage reference proposed by Eric Vottoz in 1979 which is proportional to absolute temperature when both MOS devices 501 and 502 are operated in weak inversion. This PTAT cell always has positive temperature coefficient which is determined by the operating bias current and MOS device sizes of the circuit.

Figure 6:
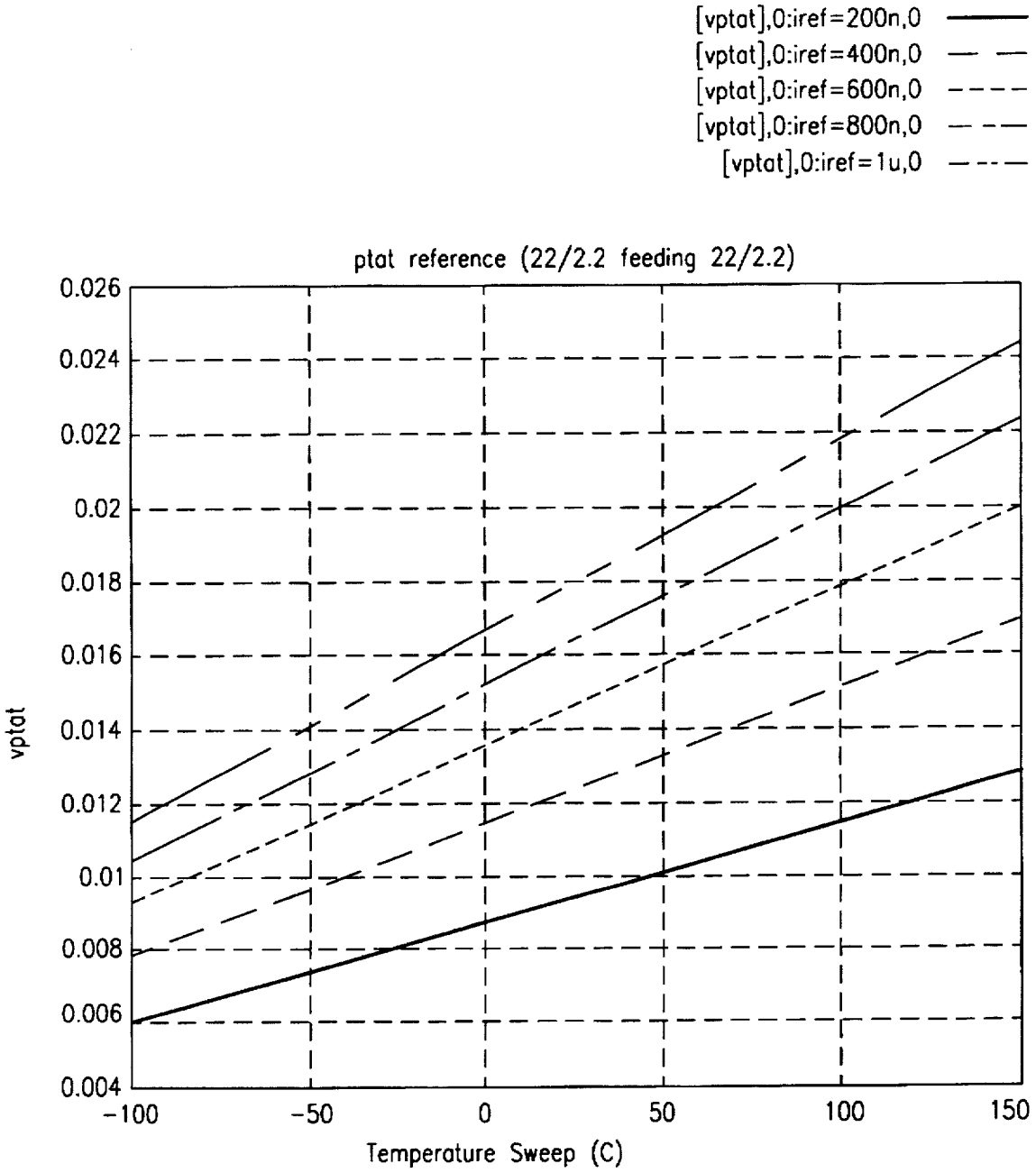
FIG. 6 is a graph illustrating the output voltage performance of the PTAT reference illustrated in FIG. 5.

Referring now to FIG. 6, there is illustrated a graph depicting the output voltage performance of the PTAT reference shown in FIG. 5. It can be seen that, to first order, the PTAT behavior is linear with a positive temperature coefficient.

Figure 7:
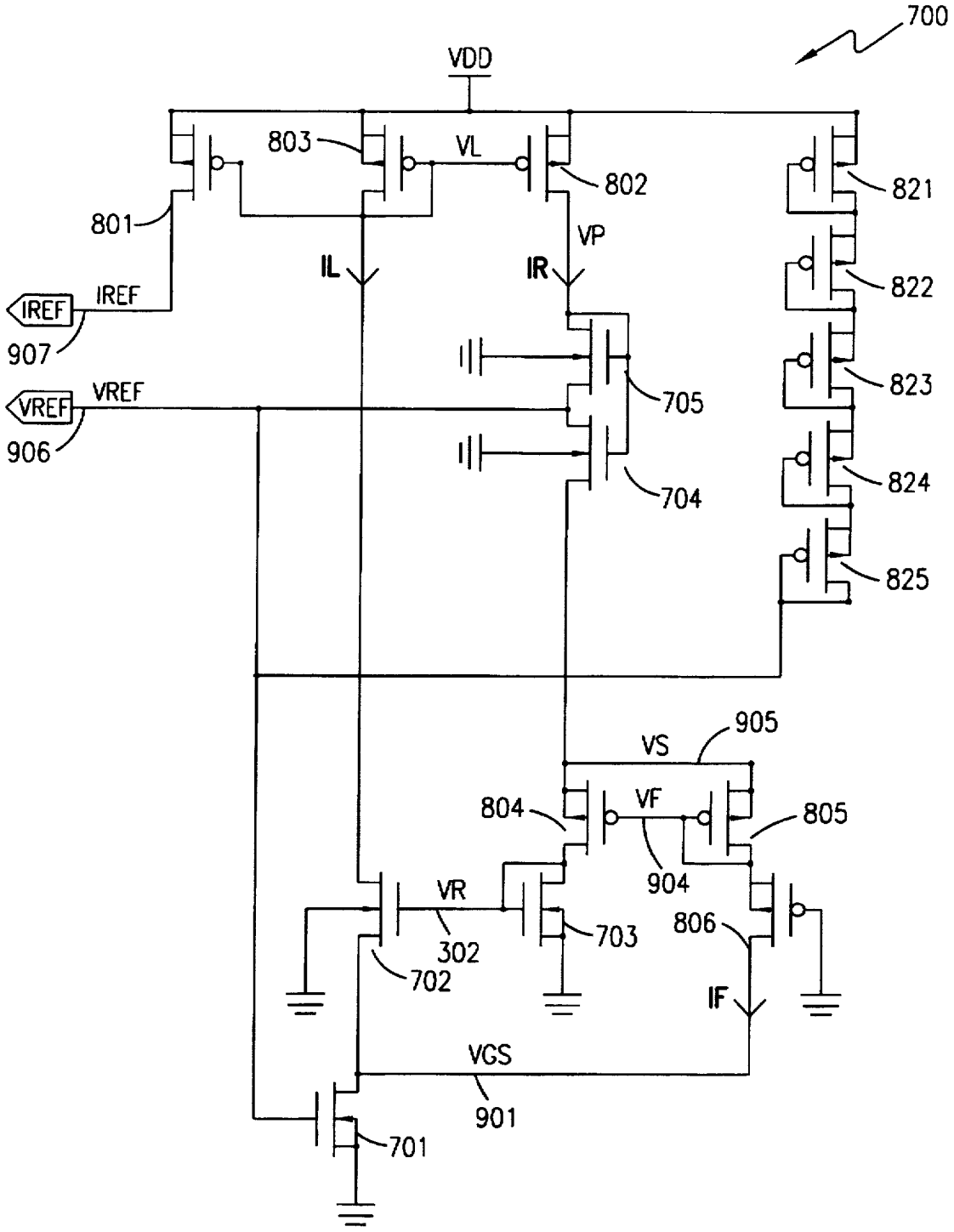
FIG. 7 is a schematic diagram illustrating an embodiment of the present invention.

Referring now to FIG. 7, there is illustrated a schematic diagram of a circuit 700 depicting an embodiment of the present invention. Good results have been achieved with the present invention when used in the context of a real time crystal clock oscillator module operating at 32768 Hz utilizing a lithium 3V battery as a backup power source, and a nominal 5V power supply when not operating in battery-backup mode.

Circuit 700 includes a floating PTAT voltage reference comprising N-Channel MOSFET 704 and N-Channel MOSFET 705. Circuit 700 further includes a startup circuit comprising P-Channel MOSFET 821, P-Channel MOSFET 822, P-Channel MOSFET 823, P-Channel MOSFET 824, and P-Channel MOSFET 825.

The well connection of N-Channel MOSFET 702 has been modified to correspond to an implementation in a conventional PSUB/NWELL semiconductor process. Within this context, the reference voltage and current as indicated by ports VREF 906 and IREF 907 are used to provide reference voltages and currents to the ultra low power portions of the crystal oscillator system which must run under battery power a majority of the time the system is operational.

Note that the embodiment illustrated in FIG. 7 represents only one potential implementation of the invention. A more general application of the invention can be envisioned in any system requiring a very low power voltage and/or current reference which has a very low temperature coefficient and simultaneously minimal voltage coefficient. Typical applications include power fail/good/reset monitors which require a stable reference as well as ultra low power analog-to-digital converters or digital-to-analog converters that are subject to extended periods of operation on low capacity battery supplies.

As described previously, the voltage/current reference circuit topology as illustrated in FIG. 1 suffers from a substantial temperature coefficient when implemented in many fabrication processes which have non-ideal β exponential temperature dependence factors. Although other aspects of the topology in FIG. 1 are acceptable, namely the voltage regulation and overall current consumption, it is the temperature coefficient which is addressed primarily by the disclosed preferred embodiment.

Non-Ideal β Circuit Analysis

The above defined expression (equation 13) can be used for the reference voltage $V_{REF}$ to calculate the reference temperature dependence in cases of non-ideal β temperature dependence. We start by noting the temperature dependence of the $V_{GS}$ and $S_{REF}$ size/shape terms and then substitute known process values into our expression for $V_{REF}$:

$$V_{GS} \propto V_{GST} \times T \tag{17}$$

$$S_{REF} \propto S_{REFT} \times \frac{T^{-1.7}}{T^{-1.2}} \approx S_{REFT} \times T^{-0.5}$$

$$V_{TN} \propto V_{TNT} \times T$$
$$V_{TP} \propto V_{TPT} \times T$$

$$\frac{\partial V_{REF}}{\partial T} = 0 \text{ for zero temperatures coefficient}$$

$$= \frac{m\left(\begin{array}{c} V_{TPT}\sqrt{S_{REFT}V_{GST}(4mTV_{TPT} - 4TV_{TNT} + (m^2S_{REFT} - 4T)V_{GST})} + \\ S_{REFT}V_{GST}(mV_{TPT} - V_{TNT} - V_{GST}) \end{array}\right)}{\sqrt{S_{REFT}V_{GST}(4T(mV_{TPT} - V_{TNT} - V_{GST}) + m^2S_{REFT}V_{GST})}}$$

$$\Downarrow$$

$$0 = \left(\begin{array}{c} V_{TPT}\sqrt{S_{REFT}V_{GST}(4mTV_{TPT} - 4TV_{TNT} + (m^2S_{REFT} - 4T)V_{GST})} + \\ S_{REFT}V_{GST}(mV_{TPT} - V_{TNT} - V_{GST}) \end{array}\right)$$

Where variable names subscripted with a terminal "T" indicate the non-temperature dependent size/shape coefficient of the appropriate circuit variable. As seen from the partial derivative, there exists a term in the numerator of the result which is negative, and proportional to $V_{GST}$. Note that the $V_{TPT}$ and $V_{TNT}$ terms have opposite signs and will thus cancel out to a first order approximation. However, the m multiplication factor (2 in Seevinck's implementation) means that there will still be a factor on the order of $V_{TPT}$ proportional to temperature, since $V_{TPT}$ and $V_{TNT}$ have approximately equivalent magnitudes and normalized signs. Note that there is no other term proportional to the temperature variable T in the numerator which can compensate for the $V_{GST}$ factor and thus eliminate the temperature coefficient over a range of temperatures. This is the fundamental flaw in the Seevinck topology when applied to non-ideal fabrication process parameters.

Note that in Seevinck's reference paper the β values had an exponential temperature dependence of −1.5 for both NCH and PCH devices, making the $S_{REF}$ temperature coefficient in this case zero. Many semiconductor fab processes typically have β temperature dependence (BEX) values of −1.7 and −1.25 for N-Channel/P-Channel devices respectively, yielding a β exponential temperature ratio ($\beta_N/\beta_P$) of approximately −0.5 (−0.45). This discrepancy in β temperature dependence means that this circuit can not be used to completely remove the temperature dependence from the reference voltage equation. In fact, it can be seen from the above analysis that the reference voltage using typical non-ideal fab process will always have a negative temperature coefficient when the β exponential temperature dependency is skewed as previously mentioned. This analysis and conclusion has been verified via the use of SPICE simulations. Correcting PTAT Reference Behavior for Non-Ideal β.

To address the issue of a non-unity temperature dependence in the $S_{REF}$ term of the Seevinck circuit, it is clear that an additional positive temperature coefficient term must be added to the expression for $V_{REF}$ in order to cancel the effect of the overall negative temperature coefficient in $V_{REF}$. This in general is a difficult task, because most available active devices have negative temperature coefficients. The use of passive devices such as resistors is probably impractical given the fact that the temperature coefficient of these elements is fixed. One solution is to utilize the CMOS PTAT voltage reference previously described by Eric Vittoz in 1979.[6] A practical implementation of a micropower reference utilizing this technique is presented in FIG. 7. This reference can be adjusted to provide a variable positive temperature coefficient by judicious sizing of the N-Channel MOSFET devices 704 and 705. Note that Vittoz recommends a N-Channel MOSFET 704/N-Channel MOSFET 705 strength ratio of approximately 10, but this value will vary in this application since the $\beta_N/\beta_P$ temperature dependence ratio will dictate the degree to which the PTAT voltage reference is needed to compensate for non-ideal β behavior. This improved circuit has the following solution for the output reference voltage:

$$V_{REF} = \tag{18}$$

$$\left[\begin{array}{c} m\sqrt{S_{REF}V_{GS}\left(mV_{TP} - V_{TN} + V_{PTAT} + \left(\frac{1}{4}S_{REF}m^2 - 1\right)V_{GS}\right)} + \\ mV_{TP} + V_{PTAT} + \frac{1}{2}m^2S_{REF}V_{GS} \end{array}\right]$$

$$V_{GS} \equiv n_{mch}U_T\ln\left(\frac{S_{P2}}{S_{P3}}\ \frac{S_{N2}}{S_{N3}}\ \frac{S_{P4}}{S_{P4}+S_{P5}}\right)$$

$$S_{REF} \equiv \frac{2\beta_{N1}}{\beta_{P5,P6}\left[1 + \frac{S_{P3}}{S_{P2}}\ \frac{S_{P4}+S_{P5}}{S_{P4}}\right]}$$

$$V_{PTAT} \equiv U_T\ln\left(1 + \frac{S_{M2}}{S_{M1}}\right)$$

[6] Eric Vottoz and Olivier Neyroud, "A Low-Voltage CMOS Bandgap Reference," *IEEE Journal of Solid-State Circuits*, June, 1979, pp. 573–577.

From this result we can use the following to deduce the relationships regarding the temperature dependence of the improved circuit:

$$V_{GS} \propto V_{GST} \times T \tag{19}$$

$$S_{REF} \propto S_{REFT} \times \frac{T^{-1.7}}{T^{-1.2}} = S_{REFT} \times T^{-0.5}$$

$$V_{TN} \propto V_{TNT} \times T$$
$$V_{TP} \propto V_{TPT} \times T$$
$$V_{PTAT} \propto V_{PTATT} \times T$$

$$\frac{\partial V_{REF}}{\partial T} = 0 \text{ for zero temperature coefficient}$$

$$= \frac{m\left(\frac{\sqrt{4S_{REF}V_{GS}\left(mV_{TPT}T - V_{TNT}T + V_{PTAT}T + \left(\frac{1}{4}S_{REF}m^2 - T\right)V_{GST}\right)}}{\left(\frac{m}{mV_{TPT} + V_{PTATT}}\right)} + mS_{REFT}V_{GST}(mV_{TPT} - V_{TNT} + V_{PTATT} - V_{GST})\right)}{\sqrt{S_{REFT}V_{GST}(4T(mV_{TPT} - V_{TNT} + V_{PTATT} - V_{GST}) + m^2S_{REFT}V_{GST})}}$$

$$\Downarrow$$

$$0 = \left(\frac{\sqrt{4S_{REF}V_{GS}\left(mV_{TPT}T - V_{TNT}T + V_{PTAT}T + \left(\frac{1}{4}S_{REF}m^2 - T\right)V_{GST}\right)}}{\left(\frac{m}{mV_{TPT} + V_{PTATT}}\right)} + mS_{REFT}V_{GST}(mV_{TPT} - V_{TNT} + V_{PTATT} - V_{GST})\right)$$

$$= \left(\frac{\sqrt{4S_{REF}V_{GS}\left[T(mV_{TPT} - V_{TNT} + V_{PTAT} - V_{GST}) + \frac{1}{4}S_{REF}m^2V_{GST}\right)}}{\left(\frac{m}{mV_{TPT} + V_{PTATT}}\right)} + mS_{REFT}V_{GST}(mV_{TPT} - V_{TNT} + V_{PTATT} - V_{GST})\right)$$

Note that in this case it is possible to more completely eliminate the temperature dependence of the $V_{REF}$ reference voltage than was possible with the original Seevinck design topology, because the additional positive $V_{PTATT}$ temperature coefficient can be adjusted to cancel the negative $V_{GST}$ temperature coefficient and thus substantially eliminate the temperature dependence from the partial derivative. It is a simple matter to adjust the other coefficients to reflect the desired target reference voltage/current and thus achieve a system substantially devoid of temperature dependence as compared to the baseline Seevinck topology.

VPTAT Reference Placement

The placement of the VPTAT voltage reference is key to the functionality of the embodiment shown in FIG. 7, the N-Channel MOSFET 704 and N-Channel MOSFET 705 series string adjusts the gate drive of N-Channel MOSFET 701 to compensate for the slight temperature dependence caused by the non-ideal P values of N-Channel MOSFET 701, P-Channel MOSFET 804, P-Channel MOSFET 805, and P-Channel MOSFET 806. Placement of the N-Channel MOSFET 704 and N-Channel MOSFET 705 as indicated also has the benefit of consuming no additional current in the baseline reference circuit. Other approaches to the placement of the N-Channel MOSFET 704 and N-Channel MOSFET 705 would typically require a mirrored current derived from P-Channel MOSFET 801, P-Channel MOSFET 802, and P-Channel MOSFET 803 and thus increase the overall current consumption of the baseline Seevinck reference circuit.

Figure 8:
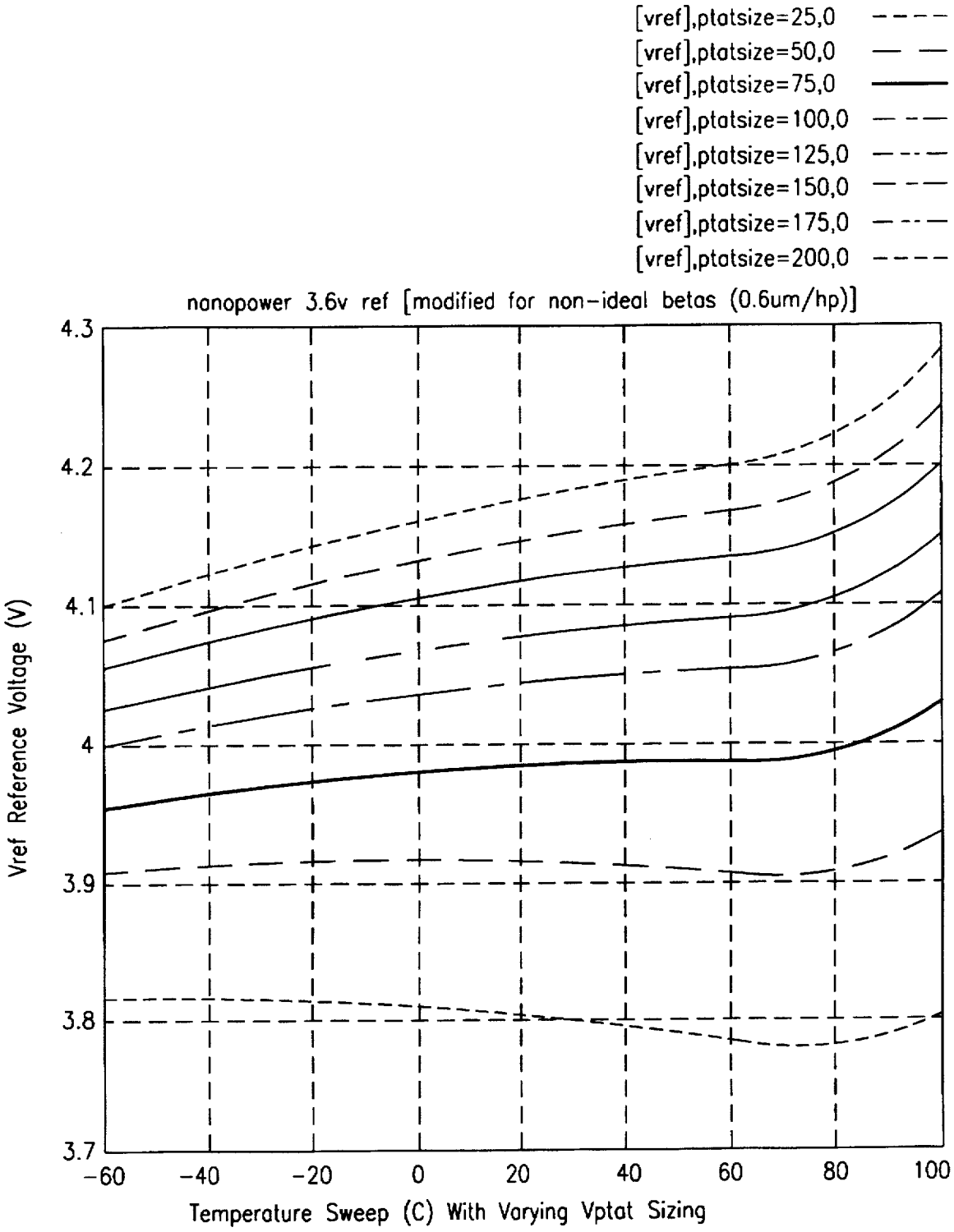
FIG. 8 is a graph illustrating the output voltage characteristic of a reference circuit of the present invention as similarly shown in FIG. 7.

Referring now to FIG. 8, there is illustrated a graph depicting the output voltage characteristic of the circuit 700 shown in FIG. 7. It is noted that the N-Channel MOSFETs 704 and 705 device sizes have been parameterized for W/L size rations of 10/PTATSIZE and PTATSIZE/10 respectively, with PTATSIZE a swept parameter form 25 to 200 in steps of 25. With proper sizing of the PTAT reference devices 704 and 705 it is possible to achieve a zero temperature coefficient at approximately room temperature. This makes the circuit shown in FIG. 7 suitable for the uses as described above.

Figure 9:
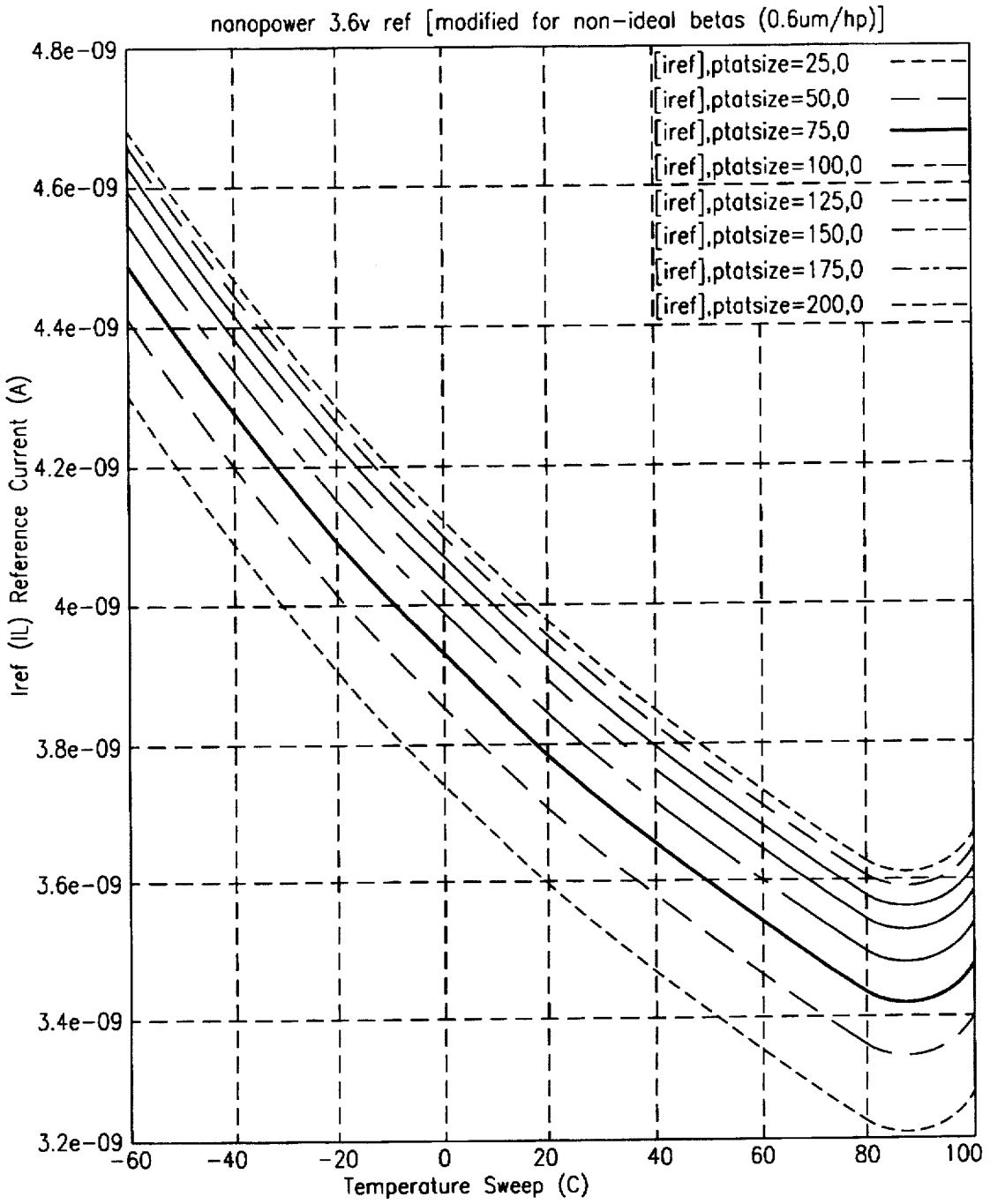
FIG. 9 is a graph illustrating simulated current regulation characteristics of the reference circuit of the present invention as similarly shown in FIG. 7.

Referring now to FIG. 9, there is illustrated a graph depicting the simulated current regulation characteristics of the reference circuit of FIG. 7. It is noted that the current regulation characteristics are improved over the characteristics as shown in FIG. 3.

Figure 10:
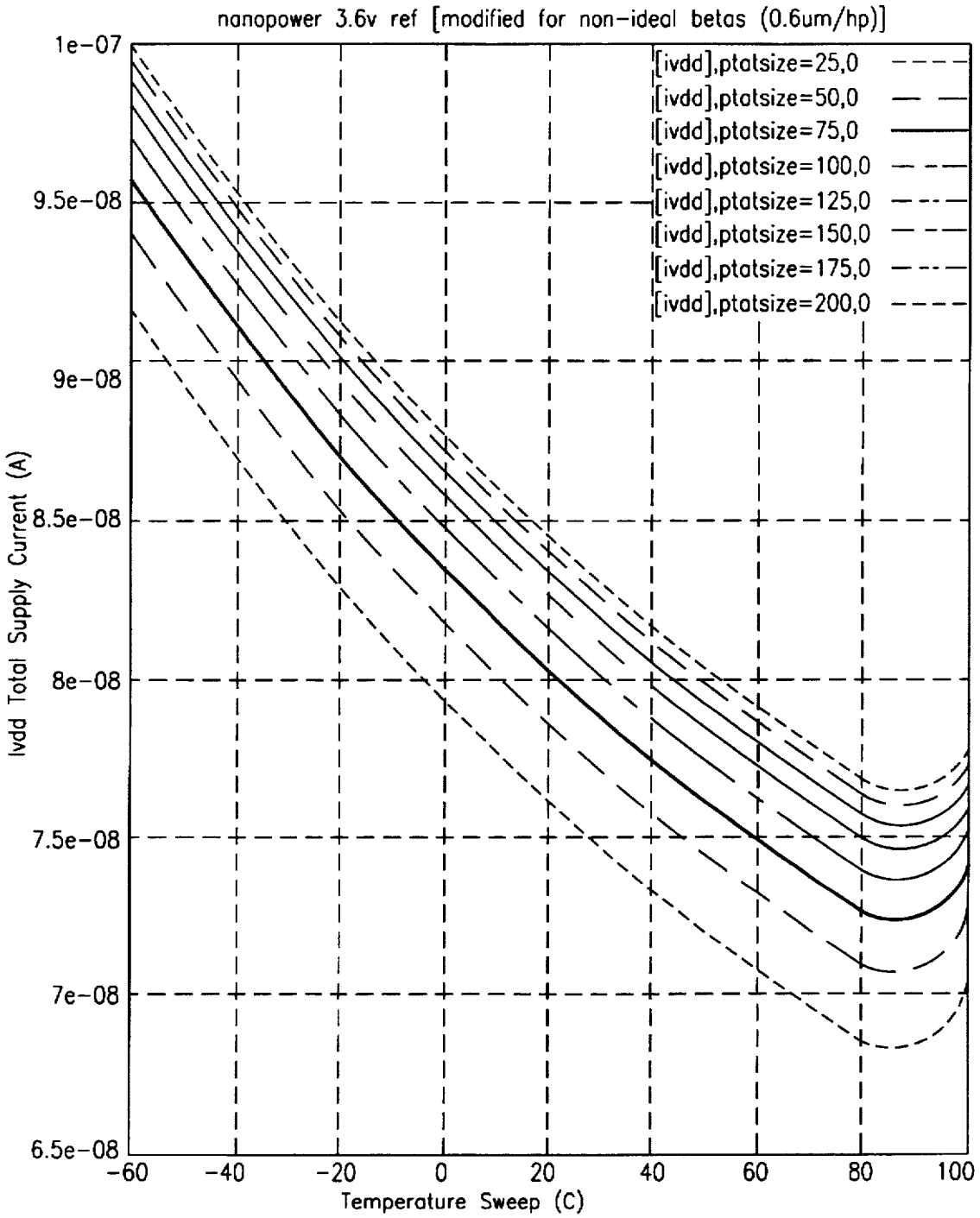
FIG. 10 is a graph illustrating simulated supply current requirements of a reference circuit of the present invention a similarly shown in FIG. 7.

Referring now to FIG. 10, there is shown a graph depicting the simulated supply current requirements of the reference circuit of FIG. 7. It is significant to note that the overall current consumption of the reference circuit is comparable to that of the circuit illustrated in FIG. 1.

Figure 11A:
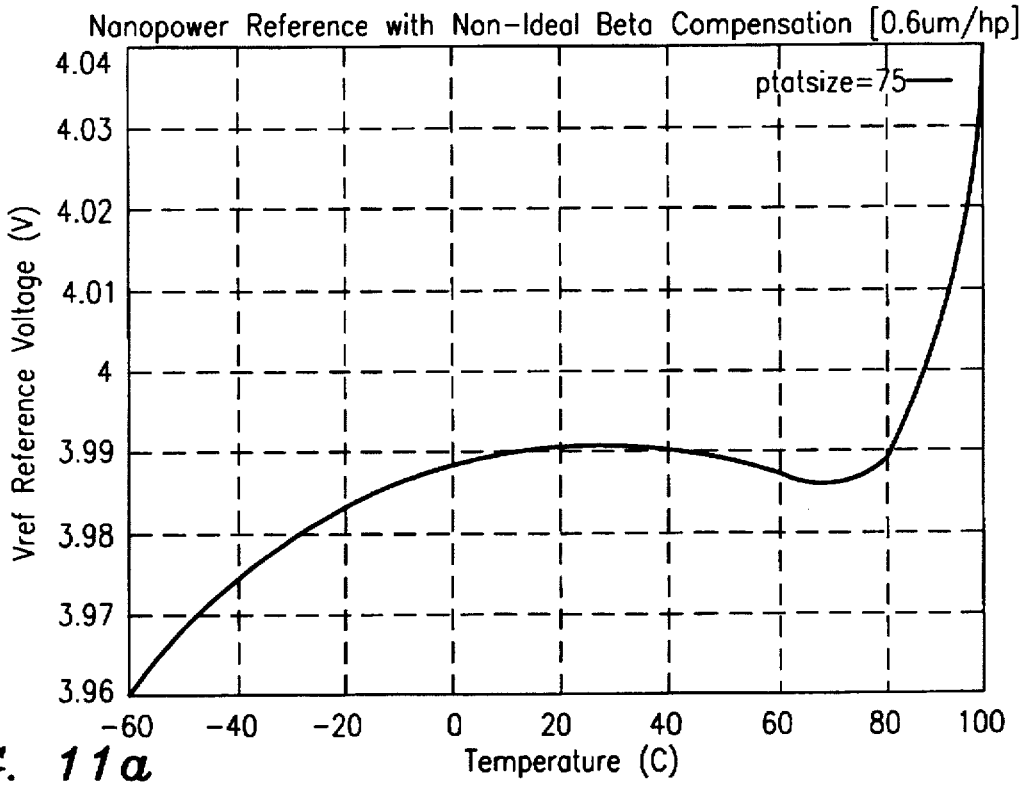
FIGS. 11*a* and 11*b* are graphs illustrating characteristics of a special case of PTATSIZE of the present invention as similarly shown in FIG. 7.
Figure 11B:
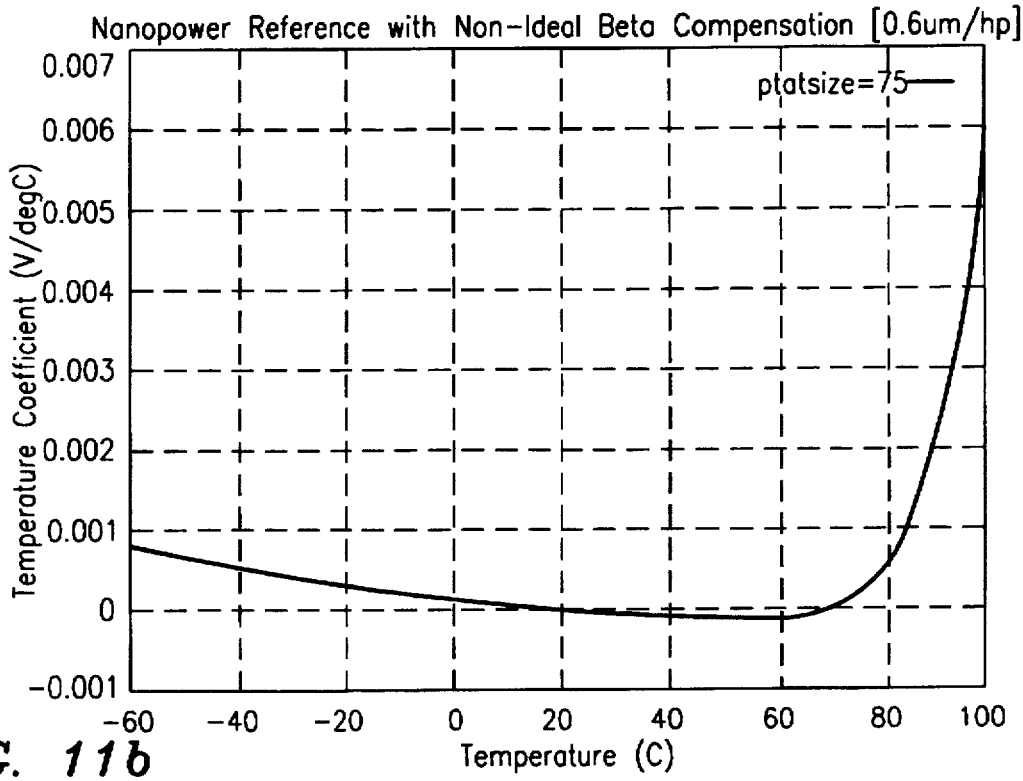

Referring now to FIGS. 11*a* and 11*b*, there is shown graphs illustrating the characteristics of the special case of PTATSIZE=75 from FIG. 8. For FIG. 11*a*, it can be seen that the curvature of the reference voltage characteristic is semi-parabolic around the room temperature point of 23° C. For FIG. 11*b*, it can be seen that at approximately 23° C. the temperature coefficient is zero. This condition is also satisfied at approximately 70° C.

FIGS. 11*a* and 11*b* demonstrate that the circuit of FIG. 7 can be made to have zero temperature coefficient with a semi-parabolic temperature dependent characteristic at approximately room temperature.

Reducing the Reference Voltage and Process Spread

One significant problem associated with both the voltage/current reference of FIG. 1 and the embodiment of present invention as depicted in FIG. 7 is that the minimum reference voltage is limited to approximately $2\pm V_{TP}$. Since in many semiconductor processes the PCH threshold voltage is larger than the NCH threshold voltage, this lower limit presents a problem when a voltage threshold of approximately $V_{TP}+V_{TN}$ is desired.

Typical ranges for $V_{TP}$ are 0.60/0.82/1.05 and for $V_{TN}$ 0.56/0.73/0.90 in a typical 0.6 μm process with 0.82V and 0.73V being the typical threshold voltage values respectively. The threshold voltage differential is approximately 90 mV between PCH and NCH devices in this reference technology. One aspect that is significant about the ranges of each threshold voltage is that the NCH thresholds have only a 340 mV range while the PCH thresholds vary by 450 mV. In industry practice, it is a well accepted fact that the ratio of PCH threshold range to NCH threshold range is higher than this spread would indicate. This ratio is typically on the order of 2:1 in standard semiconductor fab processes. Thus, reducing the reference's dependence on PCH thresholds will in turn reduce the overall voltage spread of the minimum reference voltage $V_{REF}$.

Figure 12:
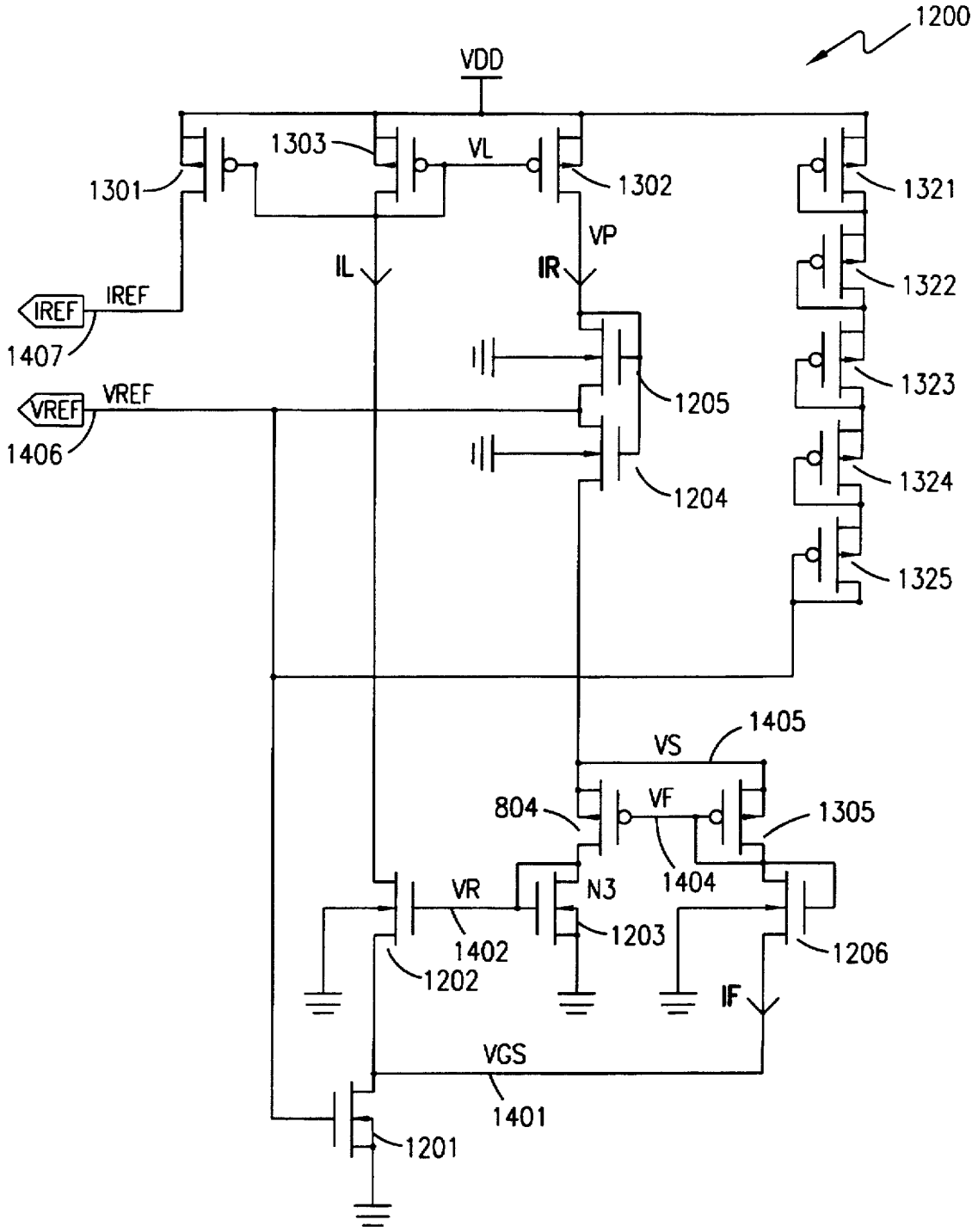
FIG. 12 is a schematic diagram illustrating another embodiment of the present invention.
Figure 13:
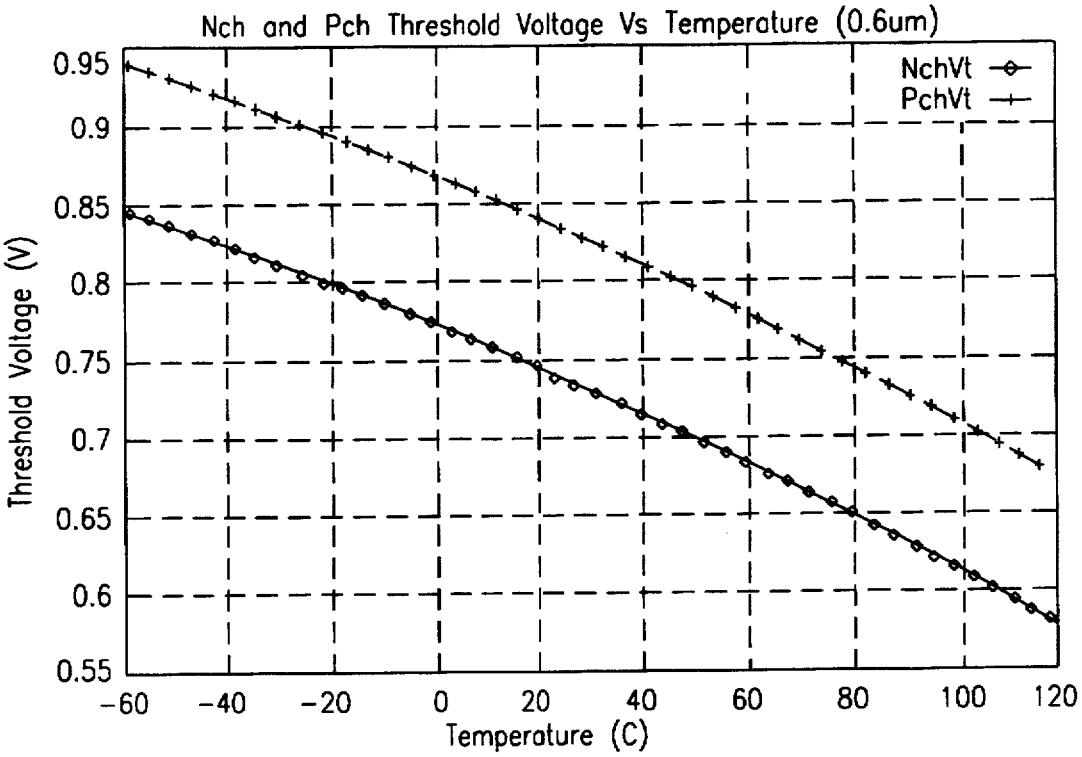
FIG. 13 is a graph illustrating a typical threshold voltage shift due to changes in temperature for PCH and NCH devices.

Referring now to FIG. 12, there is shown a schematic diagram of a circuit 1200 for an embodiment of the present invention that solves the problems of high reference voltage and $V_{TP}$ tolerance. As depicted in FIG. 12, P-Channel MOSFET 806 in FIG. 7 is replaced with a diode-connected N-Channel MOSFET 1206. This modification does not change the equations for $I_{DSP5}$ but does create a new expression for $I_{DSN6}$ as follows:

$$I_{DSP5} = \frac{\beta_{P5}}{2}\,[(V_{REF} - V_{PTAT} - V_F) - V_{TP}]^2 \tag{20}$$

$$I_{DSN6} = \frac{\beta_{N6}}{2}\,[(V_F - V_{GS}) - V_{TN}]^2$$

$$\Downarrow$$

$$V_{REF} - V_{PTAT} - V_F = \sqrt{2\frac{I_{DSP5}}{\beta_{P5}}} + V_{TP}$$

$$V_F = \sqrt{\frac{2I_{DSN6}}{\beta_{PN}}} + V_{TN} + V_{GS}$$

From this we can explicitly solve for the reference voltage $V_{REF}$ by noting that $I_{DSP5}=I_{DSN6}=I_F$, the feedback current:

$$V_{REF} = V_{TP} + V_{TN} + V_{GS} + V_{PTAT} + \sqrt{\frac{1}{\beta_{P5}}} + \sqrt{\frac{1}{\beta_{N6}}}\ \sqrt{2I_F} \tag{23}$$

$$= V_{TP} + V_{TN} + V_{GS} + V_{PTAT} + \left(\sqrt{\frac{1}{\beta_{P5}}} + \sqrt{\frac{1}{\beta_{N6}}}\right)\sqrt{2\frac{V_{GS}}{R_{DSN1}}\left[1 + \frac{S_{P3}}{S_{P2}}\ \frac{S_{P4}+S_{P5}}{S_{P4}}\right]^{-1}}$$

$$= V_{TP} + V_{TN} + V_{GS} + V_{PTAT} + \left(\sqrt{\frac{1}{\beta_{P5}}} + \sqrt{\frac{1}{\beta_{N6}}}\right)\sqrt{\frac{2\beta_{N1}}{\left[1 + \frac{S_{P3}}{S_{P2}}\ \frac{S_{P4}+S_{P5}}{S_{P4}}\right]}}\ \sqrt{V_{GS}|V_{REF} - V_{TN} - V_{GS}|}$$

This expression can be solved explicitly for $V_{REF}$ to obtain the following expressions:

$$V_{REF} = \sqrt{S_{REF}V_{GS}\left(V_{TP} + V_{GS}V_{PTAT} + \frac{1}{4}\,S_{REF}V_{GS}\right) + V_{TP} + V_{TN} + V_{PTAT} + \frac{1}{2}\,(S_{REF}+2)V_{GS}} \tag{24}$$

$$V_{GS} \equiv n_{nch}U_T \ln\left(\frac{S_{P2}}{S_{P3}}\ \frac{S_{N2}}{S_{N3}}\ \frac{S_{P4}}{S_{P4}+S_{P5}}\right)$$

$$S_{REF} \equiv \left(\sqrt{\frac{1}{\beta_{P5}}} + \sqrt{\frac{1}{\beta_{N6}}}\right)^2 \frac{2\beta_{N1}}{\left[1 + \frac{S_{P3}}{S_{P2}}\ \frac{S_{P4}+S_{P5}}{S_{P4}}\right]}$$

Reference Startup Circuit

As with any reference utilizing feedback, a startup circuit is necessary to insure that the desired operating point is achieved given the fact that the circuit has more than one stable state. For the circuit depicted in FIG. 1, it has been suggested to use a diode-connected MOSFET across the drain-source of P-Channel MOSFET 202 to achieve this functionality.

However, given the desire to operate this reference with VDD power supplies from 2V–7V, this is an impractical solution, as the MOSFET must be extremely weak (and therefore very area intensive) in order to suppress approximately 5V of $V_{GS}$ gate drive at the maximum supply voltage of 7V.

In the embodiments of the present invention, depicted in FIGS. 7 and 12, the use of stacked P-Channel MOSFETs (821–825 in FIG. 7) and (1321–1325 in FIG. 12) is preferred such that each device is operated in deep weak inversion ($0<V_{GS}<<_{V.P.}$) and has a maximum of 0.6V $V_{GS}$ drive even under maximum VDD supply voltage levels.

Note also that the back-bias of P-Channel MOSFETs (821–825 in FIG. 7) and (1321–1325 in FIG. 12) further increase the threshold voltage of this stacked MOSFET resistor to further reduce current levels at high supply voltages.

It is sufficient to provide only a leakage path greater than that present in the N-Channel MOSFET (704 in FIG. 7) and (1204 in FIG. 12), P-Channel MOSFET (804 in FIG. 7) and (1304 in FIG. 12), and N-Channel MOSFET (703 in FIG. 7) and (1203 in FIG. 12) string to overcome the undesirable stable state of $V_{REF}$=0V when VDD power is first applied.

Operational features of the invention will be appreciated by those skilled in the art upon reading the detailed description which follows with reference to the attached drawings.

The following description of the preferred embodiments make reference to device designators present in FIG. 7 and FIG. 12. The present embodiment of the invention incorporates all required circuit components on a single silicon substrate.

Simulated Linear Resistor

Referring now to FIG. 7, it can be seen that circuit 700 utilizes an enhancement N-channel MOSFET transistor 701 to implement a simulated resistance value by operating the device in the linear region of MOSFET operation with the gate-source voltage much larger than the drain-source voltage. The node voltage VGS is maintained less than 1V in order to guarantee this condition.

Practical realizations of this circuit will maintain the VGS drain-source voltage at less than 100 mV in order to limit the operational current required by the circuit. Size ratios for the linear resistor N-Channel MOSFET 701 are typically on the order of 3/3000, but will vary highly with the target process and operating point desired by the designer.

Similarly, circuit 1200 of FIG. 12, utilizes an enhancement N-channel MOSFET transistor 1201 to implement a simulated resistance value by operating the device in the linear region of MOSFET operation with the gate-source voltage much larger than the drain-source voltage. The node voltage VGS is maintained less than 1V in order to guarantee this condition.

Practical realizations of this circuit will maintain the VGS drain-source voltage at less than 100 mV in order to limit the operational current required by the circuit. Size ratios for the linear resistor N-Channel MOSFET 1201 are typically on the order of 3/3000, but will vary highly with the target process and operating point desired by the designer.

Current Mirror Loop

Referring again to FIG. 7, circuit 700 utilizes enhancement N-channel MOSFET transistors 703 and 702, and P-channel MOSFET transistors 803 and 802 to implement a current mirror loop in which the overall gain is greater than unity. This current mirror loop determines to a large extent the power consumption of the voltage/current reference. The gain of the current mirror loop is balanced by the simulated linear resistor 701.

Devices 703, 702, 803 and 802 are sized to operate the current mirror loop in deep weak inversion. An operating current of 10 nA is typical, but reference values may vary from this point by more than a factor of 1000, depending on the target circuit application.

Similarly, circuit 1200 of FIG. 12 utilizes enhancement N-channel MOSFET transistors 1203 and 1202, and P-channel MOSFET transistors 1303 and 1302 to implement a current mirror loop in which the overall gain is greater than unity. This current mirror loop determines to a large extent the power consumption of the voltage/current reference. The gain of the current mirror loop is balanced by the simulated linear resistor 1301.

Devices 1203, 1202, 1303 and 1302 are sized to operate the current mirror loop in deep weak inversion. An operating current of 10 nA is typical, but reference values may vary from this point by more than a factor of 1000, depending on the target circuit application.

Feedback Loop

Referring to FIG. 7, circuit 700 utilizes enhancement MOSFET transistors 804, 805 and 806 to provide current feedback from the reference node VS 905 back to the VGS summing node point 901. This feedback arrangement provides PTAT voltage stabilization of the voltage at node VS with a negative temperature coefficient if the process being used implements a non-ideal β exponential temperature gain degradation factor.

Devices 804, 805 and 806 are typically constructed as long-channel weak devices since they are intended to be biased in the fully saturated mode of MOSFET operation.

Similarly, circuit 1200 shown in FIG. 12 utilizes enhancement MOSFET transistors 1304, 1305 and 1306 to provide current feedback from the reference node VS 1405 back to the VGS summing node point 1401. This feedback arrangement provides PTAT voltage stabilization of the voltage at node VS with a negative temperature coefficient if the process being used implements a non-ideal β exponential temperature gain degradation factor.

Devices 1304, 1305 and 1306 are typically constructed as long-channel weak devices since they are intended to be biased in the fully saturated mode of MOSFET operation.

Positive PTAT Reference

Referring now to FIG. 7, circuit 700 utilizes two N-channel enhancement MOSFET transistors 704 and 705 operating in weak inversion to compensate for the negative PTAT behavior of the reference node VS 905. The positive PTAT nature of MOS devices 704 and 705 can be adjusted via proper sizing to compensate to a high degree the negative PTAT behavior of the reference node VS 905. This additional positive PTAT voltage also tends to correct for β degradation within N-Channel MOSFET 701 by increasing its gate-source drive to minimize the effects of gain loss at higher temperatures.

Similarly, circuit 1200 depicted in FIG. 12 utilizes two N-channel enhancement MOSFET transistors 1204 and 1205 operating in weak inversion to compensate for the negative PTAT behavior of the reference node VS 1405. The positive PTAT nature of MOS devices 1204 and 1205 can be adjusted via proper sizing to compensate to a high degree the negative PTAT behavior of the reference node VS 1405. This additional positive PTAT voltage also tends to correct for β degradation within N-Channel MOSFET 1201 by increasing its gate-source drive to minimize the effects of gain loss at higher temperatures.

Referring now to both FIGS. 7 and 12, as can be appreciated, each of the N-channel enhancement MOSFET transistors and each of the P-channel enhancement MOSFET transistors can be adjusted in size using parallel MOS devices of similar species across existing circuit elements for adjusting the corresponding effective devices sizes.

Those skilled in the art will recognize that there many ways to optimize and implement the voltage/current references illustrated in FIGS. 7 and 12 in order to obtain a variety of reference voltages and currents depending on the target semiconductor process technology as well as the target application for the reference voltage/current values.

PCH VPTAT REFERENCE

Figure 14:
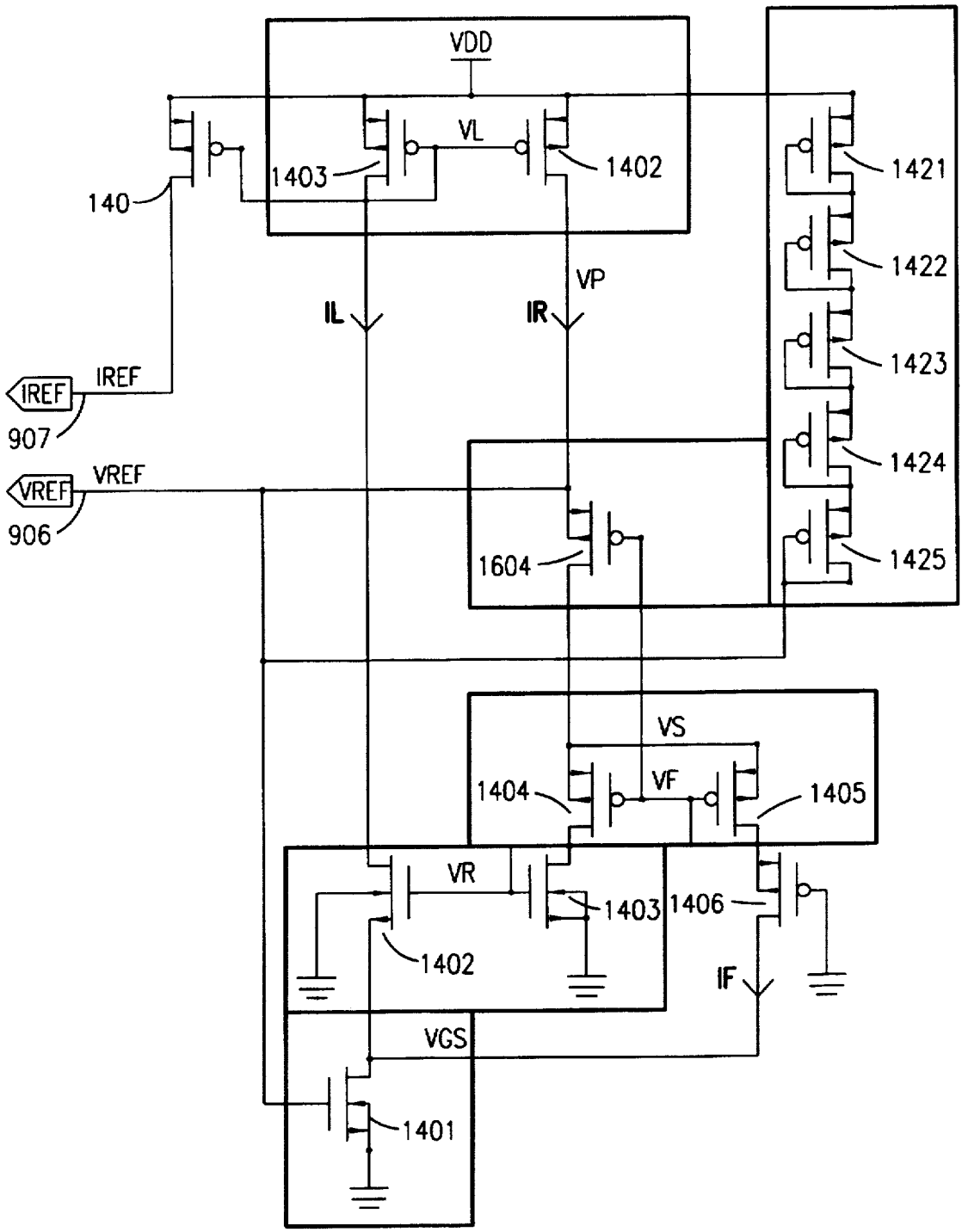
FIG. 14 is a schematic diagram illustrating yet another embodiment of the present invention.

Referring now to FIG. 14, there is illustrated another embodiment of the present invention. As depicted the VPTAT generator and a portion of the feedback loop have been combined. In particular devices 1404 and 1604 combine to generate a PTAT voltage between VREF and VS. The advantage of this topology is that it can potentially operate at lower supply voltages than the topologies illustrated in FIGS. 7 and 11.

BLOCK DIAGRAM OVERVIEW

Figure 15:
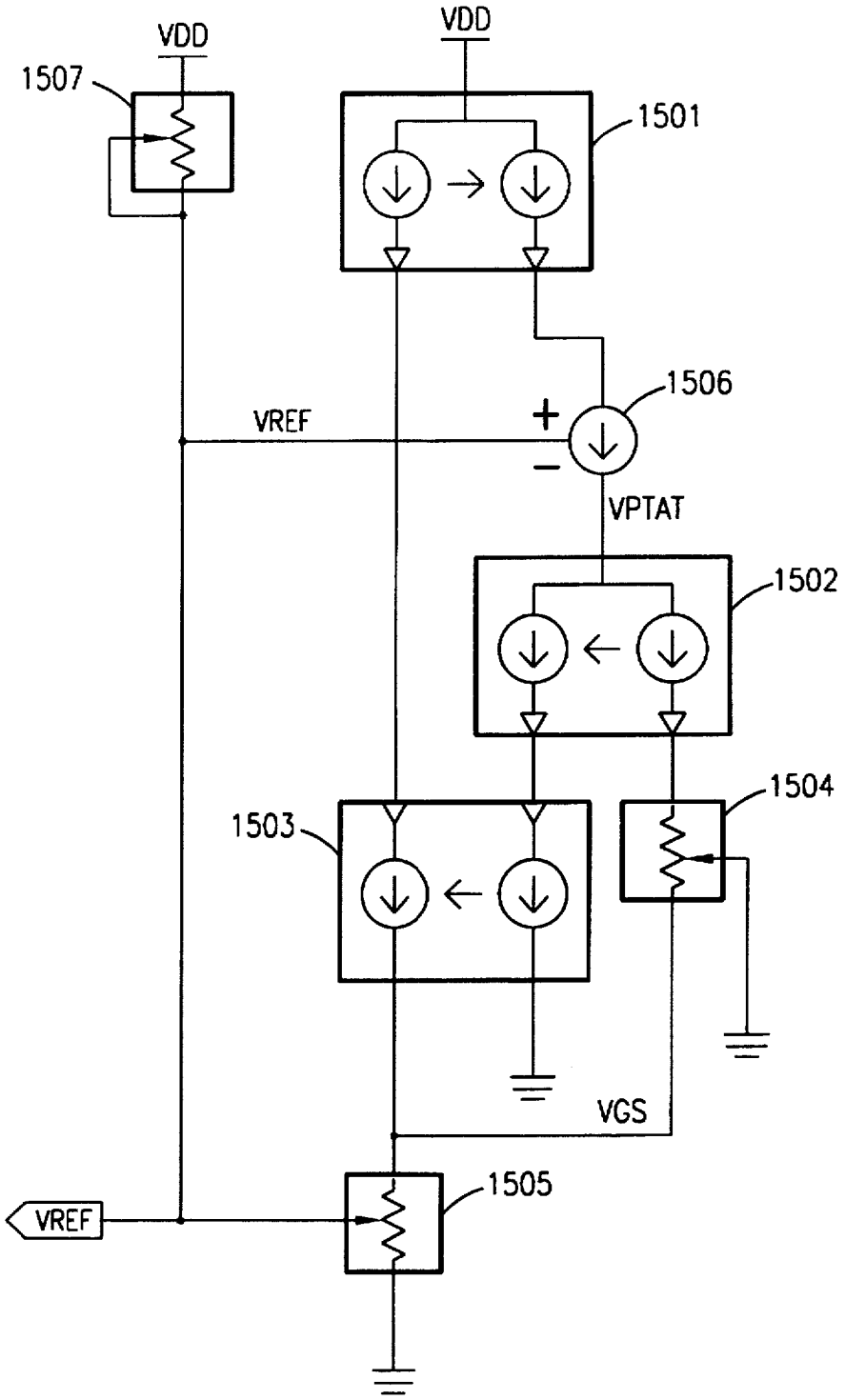
FIG. 15 is block diagram illustrating an embodiment of the present invention.

Referring now to FIG. 15, block diagram 1500 depicts and incorporates the basic overall topology of the embodiments illustrated in FIGS. 7, 12 and 14, which have been described herein. The current mirrors 1501 and 1502 may in general be constructed with any suitable current conveyor mechanism. The degenerated current mirror 1503 is combined with a voltage controlled resistor 1505 to regulate the current within the closed current loop defined by the path connecting current mirror 1501, VPTAT 1506, current mirror 1502, and current mirror 1503. A portion of the current in this loop is fed back via current mirror 1502 through a voltage controlled resistor 1504.

In general, the temperature coefficients of resistors 1504 and 1505 cancel to reduce the temperature drift. A proportional to absolute temperature voltage reference 1506 is used to boost the VPTAT reference voltage with increasing temperature to compensate for the loss in gain in resistor 1505 at high temperature.

Finally, a voltage controlled resistance 1507 is utilized to guarantee proper startup operation for the circuit. It is contemplated to be within the scope of this invention that this start up function my be performed equivalently via the use of a suitable sized capacitor.

Although preferred embodiments of the invention have been described in detail, it should be understood that various substitutions, alterations, and modifications can be made without departing from the spirit and scope of the invention as defined in the appended claims. As will be recognized by those skilled in the art, the innovative concepts described in the present application can be modified and varied over a tremendous range of applications, and accordingly their scope is not limited except by the allowed claims.

What is claimed is:

1. A temperature compensated nanopower voltage/current reference, comprising:

a first N-channel enhancement MOSFET;

a second N-channel enhancement MOSFET;

a third N-channel enhancement MOSFET;

a fourth N-channel enhancement MOSFET;

a fifth N-channel enhancement MOSFET;

each of said first, second, third, fourth and fifth N-channel enhancement MOSFETs including a drain connection, a gate connection, a source connection, and a bulk connection;

a first P-channel enhancement MOSFET;

a second P-channel enhancement MOSFET;

a third P-channel enhancement MOSFET;

a fourth P-channel enhancement MOSFET;

a fifth P-channel enhancement MOSFET;

a sixth P-channel enhancement MOSFET;

a seventh P-channel enhancement MOSFET;

an eighth P-channel enhancement MOSFET;

a ninth P-channel enhancement MOSFET;

a tenth P-channel enhancement MOSFET;

an eleventh P-channel enhancement MOSFET;

each of said first, second, third, fourth, fifth, sixth, seventh, eighth, ninth, tenth and eleventh P-channel enhancement MOSFETs including a drain connection, a gate connection, a source connection, and a bulk connection;

wherein a first node is created by connecting said source connections of each of said first, second, third and seventh P-channel enhancement MOSFETs, said bulk connections of each of said first, second, third and seventh P-channel enhancement MOSFETs;

a second node is created by said drain connection of said first P-channel enhancement MOSFET;

a third node is created by connecting each of said gate connections of said first, second and third P-channel enhancement MOSFETs, said drain connection of said fourth N-channel enhancement MOSFET, said drain connection of said third P-channel enhancement MOSFET;

a fourth node is created by connecting said gate connection of said third N-channel enhancement MOSFET, said source connection of said second N-channel enhancement MOSFET, said drain connection of said first N-channel enhancement MOSFET, said gate connection of said eleventh P-channel enhancement MOSFET, and said drain connection of said eleventh P-channel enhancement MOSFET;

a fifth node is created by connecting said drain connection of said third N-channel enhancement MOSFET, said source connection of said fourth N-channel enhancement MOSFET, and said drain connection of said sixth P-channel enhancement MOSFET;

a sixth node is created by connecting each of said gate connections of said fourth and fifth N-channel enhancement MOSFETs, said drain connection of said fifth N-channel enhancement MOSFET, and said drain connection of said fourth P-channel enhancement MOSFET;

a seventh node is created by connecting said drain connection of said second P-channel enhancement MOSFET, said gate connections of each of said first and second N-channel enhancement MOSFET and said drain connection of said second N-channel enhancement MOSFET;

an eighth node is created by connecting said source connections of each of said fourth and fifth P-channel enhancement MOSFETs, said source connection of said first N-channel enhancement MOSFET, and said bulk connections of each of said fourth and fifth P-channel enhancement MOSFETs;

a ninth node is created by connecting said gate connections of each of said fourth and fifth P-channel enhancement MOSFETs, said drain connection of said fifth P-channel enhancement MOSFET, said source connection of said sixth P-channel enhancement MOSFET, and said bulk connection of said sixth P-channel enhancement MOSFET, a tenth node is created by connecting said gate connection of said seventh P-channel enhancement MOSFET, said drain connection of said seventh P-channel enhancement MOSFET, said source connection of said eighth P-channel enhancement MOSFET, and said bulk connection of said eighth P-channel enhancement MOSFET;

an eleventh node is created by connecting said gate connection of said eighth P-channel enhancement MOSFET, said drain connection of said eighth P-channel enhancement MOSFET, said source connection of said ninth P-channel enhancement MOSFET, and said bulk connection of said ninth P-channel enhancement MOSFET;

a twelfth node is created by connecting said gate connection of said ninth P-channel enhancement MOSFET, said drain connection of said ninth P-channel enhancement MOSFET, said source connection of said tenth P-channel enhancement MOSFET, and said bulk connection of said tenth P-channel enhancement MOSFET;

a thirteenth node is created by connecting said gate connection of said tenth P-channel enhancement MOSFET, said drain connection of said tenth P-channel enhancement MOSFET, said source connection of said eleventh P-channel enhancement MOSFET, and said bulk connection of said eleventh P-channel enhancement MOSFET; and a fourteenth node is created by connecting said gate connection of said sixth P-channel enhancement MOSFET, said bulk connections of each of said first, second, third, fourth and fifth N-channel enhancement MOSFETs, and said source connections of each of said third and fifth N-channel enhancement MOSFETs.

2. The temperature compensated nanopower voltage/current reference as recited in claim 1, wherein at least one of said seventh, eighth, ninth, tenth and eleventh P-channel enhancement MOSFETs is a diode-connected MOSFET.

3. The temperature compensated nanopower voltage/current reference as recited in claim 1, wherein each of said first, second, third, fourth and fifth N-channel enhancement MOSFETs and each of said first, second, third, fourth, fifth, sixth, seventh, eighth, ninth, tenth and eleventh P-channel enhancement MOSFETs can be adjusted in size using parallel MOS devices of similar species across existing circuit elements for adjusting corresponding effective devices sizes.

4. A temperature compensated nanopower voltage/current reference, comprising:

a first N-channel enhancement MOSFET, further comprising a drain connection, a gate connection, a source connection, and a bulk connection;

a second N-channel enhancement MOSFET, further comprising a drain connection, a gate connection, a source connection, and a bulk connection;

a third N-channel enhancement MOSFET, further comprising a drain connection, a gate connection, a source connection, and a bulk connection;

a fourth N-channel enhancement MOSFET, further comprising a drain connection, a gate connection, a source connection, and a bulk connection;

a fifth N-channel enhancement MOSFET, further comprising a drain connection, a gate connection, a source connection, and a bulk connection;

a sixth N-channel enhancement MOSFET, further comprising a drain connection, a gate connection, a source connection, and a bulk connection;

a first P-channel enhancement MOSFET, further comprising a drain connection, a gate connection, a source connection, and a bulk connection;

a second P-channel enhancement MOSFET, further comprising a drain connection, a gate connection, a source connection, and a bulk connection;

a third P-channel enhancement MOSFET, further comprising a drain connection, a gate connection, a source connection, and a bulk connection;

a fourth P-channel enhancement MOSFET, further comprising a drain connection, a gate connection, a source connection, and a bulk connection;

a fifth P-channel enhancement MOSFET, further comprising a drain connection, a gate connection, a source connection, and a bulk connection;

a sixth P-channel enhancement MOSFET, further comprising a drain connection, a gate connection, a source connection, and a bulk connection;

a seventh P-channel enhancement MOSFET, further comprising a drain connection, a gate connection, a source connection, and a bulk connection;

an eighth P-channel enhancement MOSFET, further comprising a drain connection, a gate connection, a source connection, and a bulk connection;

a ninth P-channel enhancement MOSFET, further comprising a drain connection, a gate connection, a source connection, and a bulk connection; and a tenth P-channel enhancement MOSFET, further comprising a drain connection, a gate connection, a source connection, and a bulk connection;

wherein a first node is created by connecting said source connection of said first P-channel enhancement MOSFET, said source connection of said second P-channel enhancement MOSFET, said bulk connection of said second P-channel enhancement MOSFET, said source connection of said sixth P-channel enhancement MOSFET, said bulk connection of said sixth P-channel enhancement MOSFET, said source connection of said third P-channel enhancement MOSFET, said bulk connection of said third P-channel enhancement MOSFET, and said bulk connection of said first P-channel enhancement MOSFET;

a second node is created by said drain connection of said first P-channel enhancement MOSFET;

a third node is created by connecting said gate connection of said first P-channel enhancement MOSFET, said drain connection of said fourth N-channel enhancement MOSFET, said drain connection of said third P-channel enhancement MOSFET, said gate connection of said second P-channel enhancement MOSFET, and said gate connection of said third P-channel enhancement MOSFET;

a fourth node is created by connecting said gate connection of said third N-channel enhancement MOSFET, said source connection of said second N-channel enhancement MOSFET, said drain connection of said first N-channel enhancement MOSFET, said gate connection of said tenth P-channel enhancement MOSFET, and said drain connection of said tenth P-channel enhancement MOSFET;

a fifth node is created by connecting said drain connection of said third N-channel enhancement MOSFET, said source connection of said fourth N-channel enhancement MOSFET, and said source connection of said sixth N-channel enhancement MOSFET;

a sixth node is created by connecting said gate connection of said fourth N-channel enhancement MOSFET, said drain connection of said fifth N-channel enhancement MOSFET, said drain connection of said fourth P-channel enhancement MOSFET, and said gate connection of said fifth N-channel enhancement MOSFET;

a seventh node is created by connecting said drain connection of said second P-channel enhancement MOSFET, said gate connection of said second N-channel enhancement MOSFET, said gate connection of said first N-channel enhancement MOSFET, and said drain connection of said second N-channel enhancement MOSFET;

an eighth node is created by connecting said source connection of said fourth P-channel enhancement MOSFET, said source connection of said first N-channel enhancement MOSFET, said bulk connection of said fourth P-channel enhancement MOSFET, said source connection of said fifth P-channel enhancement MOSFET, and said bulk connection of said fifth P-channel enhancement MOSFET;

a ninth node is created by connecting said gate connection of said fourth P-channel enhancement MOSFET, said gate connection of said sixth N-channel enhancement MOSFET, said drain connection of said fifth P-channel enhancement MOSFET, said drain connection of said sixth N-channel enhancement MOSFET, and said gate connection of said fifth P-channel enhancement MOSFET;

a tenth node is created by connecting said gate connection of said sixth P-channel enhancement MOSFET, said drain connection of said sixth P-channel enhancement MOSFET, said source connection of said seventh P-channel enhancement MOSFET, and said bulk connection of said seventh P-channel enhancement MOSFET;

an eleventh node is created by connecting said gate connection of said seventh P-channel enhancement MOSFET, said drain connection of said seventh P-channel enhancement MOSFET, said source connection of said eighth P-channel enhancement MOSFET, and said bulk connection of said eighth P-channel enhancement MOSFET;

a twelfth node is created by connecting said gate connection of said eighth P-channel enhancement MOSFET, said drain connection of said eighth P-channel enhancement MOSFET, said source connection of said ninth P-channel enhancement MOSFET, and said bulk connection of said ninth P-channel enhancement MOSFET;

a thirteenth node is created by connecting said gate connection of said ninth P-channel enhancement MOSFET, said drain connection of said ninth P-channel enhancement MOSFET, said source connection of said tenth P-channel enhancement MOSFET, and said bulk connection of said tenth P-channel enhancement MOSFET; and a fourteenth node is created by connecting said bulk connection of said sixth N-channel enhancement MOSFET, said bulk connection of said first N-channel enhancement MOSFET, said bulk connection of said second N-channel enhancement MOSFET, said source connection of said fifth N-channel enhancement MOSFET, said bulk connection of said fifth N-channel enhancement MOSFET, said bulk connection of said fourth N-channel enhancement MOSFET, said source connection of said third N-channel enhancement MOSFET, and said bulk connection of said third N-channel enhancement MOSFET.

5. The temperature compensated nanopower voltage/current reference as recited in claim 4, wherein at least one of said sixth, seventh, eighth, ninth, and tenth P-channel enhancement MOSFETs is a diode-connected MOSFET.

6. The temperature compensated nanopower voltage/current reference as recited in claim 4, wherein each of said first, second, third, fourth, fifth and sixth N-channel enhancement MOSFETs and each of said first, second, third, fourth, fifth, sixth, seventh, eighth, ninth, and tenth P-channel enhancement MOSFETs can be adjusted in size using parallel MOS devices of similar species across existing circuit elements for adjusting corresponding effective devices sizes.

7. A temperature compensated voltage/current reference, comprising:

at least twelve P-channel enhancement MOSFETs, each of said at least twelve P-channel enhancement MOSFETs including a drain connection, a gate input connection, a source connection, and a bulk input connection;

at least three N-channel enhancement MOSFETs, each of said at least three N-channel enhancement MOSFETs including a drain connection, a gate input connection, a source connection, and a bulk input connection;

said source connection of said second P-channel enhancement MOSFET, said source connection of said third P-channel enhancement MOSFET, said bulk input connection of said third P-channel enhancement MOSFET, said source connection of said eighth P-channel enhancement MOSFET, said bulk input connection of said eighth P-channel enhancement MOSFET, said source connection of said fourth P-channel enhancement MOSFET, said bulk input connection of said fourth P-channel enhancement MOSFET, and said bulk input connection of said second P-channel enhancement MOSFET being electrically connected;

said gate input connection of said second P-channel enhancement MOSFET, said drain connection of said second N-channel enhancement MOSFET, said drain connection of said fourth P-channel enhancement MOSFET, said gate input connection of said third P-channel enhancement MOSFET, and said gate input connection of said fourth P-channel enhancement MOSFET being electrically connected;

said gate input connection of said first N-channel enhancement MOSFET, said source connection of said first P-channel enhancement MOSFET, said bulk input connection of said first P-channel enhancement MOSFET, said drain connection of said third P-channel enhancement MOSFET, said gate input connection of said twelfth P-channel enhancement MOSFET, and said drain connection of said twelfth P-channel enhancement MOSFET being electrically connected;

said drain connection of said first N-channel enhancement MOSFET, said source connection of said second N-channel enhancement MOSFET, and said drain connection of said seventh P-channel enhancement MOSFET being electrically connected;

said gate input connection of said second N-channel enhancement MOSFET, said drain connection of said third N-channel enhancement MOSFET, said drain connection of said fifth P-channel enhancement MOSFET, and said gate input connection of said third N-channel enhancement MOSFET being electrically connected;

said source connection of said fifth P-channel enhancement MOSFET, said drain connection of said first P-channel enhancement MOSFET, said bulk input connection of said fifth P-channel enhancement MOSFET, said source connection of said sixth P-channel enhancement MOSFET, and said bulk input connection of said sixth P-channel enhancement MOSFET being electrically connected;

said gate input connection of said fifth P-channel enhancement MOSFET, said gate input connection of said first P-channel enhancement MOSFET, said drain connection of said sixth P-channel enhancement MOSFET, said source connection of said seventh P-channel enhancement MOSFET, said bulk input connection of said seventh P-channel enhancement MOSFET, and said gate input connection of said sixth P-channel enhancement MOSFET being electrically connected;

said gate input connection of said eighth P-channel enhancement MOSFET, said drain connection of said eighth P-channel enhancement MOSFET, said source connection of said ninth P-channel enhancement MOSFET, and said bulk input connection of said ninth P-channel enhancement MOSFET being electrically connected;

said gate input connection of said ninth P-channel enhancement MOSFET, said drain connection of said ninth P-channel enhancement MOSFET, said source connection of said tenth P-channel enhancement MOSFET, and said bulk input connection of said tenth P-channel enhancement MOSFET being electrically connected;

said gate input connection of said tenth P-channel enhancement MOSFET, said drain connection of said tenth P-channel enhancement MOSFET, said source connection of said eleventh P-channel enhancement MOSFET, and said bulk input connection of said eleventh P-channel enhancement MOSFET being electrically connected;

said gate input connection of said eleventh P-channel enhancement MOSFET, said drain connection of said eleventh P-channel enhancement MOSFET, said source connection of said twelfth P-channel enhancement MOSFET, and said bulk input connection of said twelfth P-channel enhancement MOSFET being electrically connected;

said gate input connection of said seventh P-channel enhancement MOSFET, said source connection of said third N-channel enhancement MOSFET, said bulk input connection of said third N-channel enhancement MOSFET, said bulk input connection of said second N-channel enhancement MOSFET, said source connection of said first N-channel enhancement MOSFET, and said bulk input connection of said first N-channel enhancement MOSFET being electrically connected.

* * * * *

UNITED STATES PATENT AND TRADEMARK OFFICE

CERTIFICATE OF CORRECTION

PATENT NO. : 5,798,669

DATED : Aug. 25, 1998

INVENTOR(S) : Klughart

It is certified that error appears in the above-identified patent and that said Letters Patent is hereby corrected as shown below:

| | |
|---|---|
| Column 15, line 54 | Replace "P" With --β-- |
| Column 17, line 6 | Replace "$2 \pm V_{TP}$" With --$2 \times V_{TP}$-- |
| Column 18, line 15 | Replace "$\sqrt{\frac{1}{\beta_{P5}}} + \sqrt{\frac{1}{\beta_{N6}}}$" With --$\left(\sqrt{\frac{1}{\beta_{P5}}} + \sqrt{\frac{1}{\beta_{N6}}}\right)$-- |
| Column 18, line 61 | Replace "$V_{.P.}$" With --$V_P$-- |

Signed and Sealed this

First Day of February, 2000

*Attest:*

*Attesting Officer*

Q. TODD DICKINSON

*Acting Commissioner of Patents and Trademarks*